US011377972B1

(12) United States Patent
Chung et al.

(10) Patent No.: US 11,377,972 B1
(45) Date of Patent: Jul. 5, 2022

(54) AIRFOIL PROFILE

(71) Applicant: DOOSAN HEAVY INDUSTRIES & CONSTRUCTION CO., LTD., Changwon-si (KR)

(72) Inventors: Jaehoon Chung, Changwon (KR); Krishna C. Veluru, Concord, NC (US); Sungryong Lee, Changwon (KR); Jaewook Song, Changwon (KR)

(73) Assignee: DOOSAN HEAVY INDUSTRIES & CONSTRUCTION CO., LTD., Changwon-si (KR)

( * ) Notice: Subject to any disclaimer, the term of this patent is extended or adjusted under 35 U.S.C. 154(b) by 0 days.

(21) Appl. No.: 17/185,672

(22) Filed: Feb. 25, 2021

(51) Int. Cl.
*F01D 9/04* (2006.01)
*F01D 5/30* (2006.01)
*F04D 29/54* (2006.01)

(52) U.S. Cl.
CPC ..... *F01D 9/041* (2013.01); *F01D 5/3007* (2013.01); *F04D 29/542* (2013.01); *F05D 2300/611* (2013.01)

(58) Field of Classification Search
None
See application file for complete search history.

(56) References Cited

U.S. PATENT DOCUMENTS 8,057,188 B2 11/2011 Parker et al.
8,113,773 B2 2/2012 Hudson et al.
8,192,168 B2 6/2012 Bonini et al.
8,556,588 B2 10/2013 Shrum et al.
8,591,193 B2 11/2013 Kathika et al.
9,523,284 B2 12/2016 Miller et al.
9,890,790 B2 2/2018 Miller et al.
2008/0101953 A1* 5/2008 Huskins ..... F01D 5/141 416/223 R
2008/0101954 A1* 5/2008 Latimer ..... F04D 29/324 416/223 R
2008/0101955 A1* 5/2008 McGowan ..... F04D 29/324 416/223 R
2008/0101956 A1* 5/2008 Douchkin ..... F04D 29/324 416/223 R
2008/0101957 A1* 5/2008 Columbus ..... F04D 29/541 416/223 R
2008/0101958 A1* 5/2008 Latimer ..... F04D 29/324 416/223 R
2008/0101959 A1* 5/2008 McRae ..... F01D 5/141 416/223 R
2008/0240924 A1* 10/2008 Kizuka ..... F01D 5/141 416/223 R
2009/0290987 A1* 11/2009 Parker ..... F01D 5/141 416/241 R
2010/0008784 A1* 1/2010 Shafique ..... F01D 5/141 416/223 R (Continued)

*Primary Examiner* — Michael Lebentritt
(74) *Attorney, Agent, or Firm* — Shook, Hardy & Bacon, L.L.P.

(57) ABSTRACT

Compressor components, such as blades and vanes, having an airfoil portion with an uncoated, nominal profile substantially in accordance with Cartesian coordinate values of X, Y, and Z set forth in Table 1. X and Y are distances in inches which, when connected by smooth continuing arcs, define airfoil profile sections at each Z distance in inches. The profile sections at the Z distances are joined smoothly with one another to form a complete airfoil shape.

20 Claims, 7 Drawing Sheets

(56) References Cited

U.S. PATENT DOCUMENTS

2010/0061850 A1* 3/2010 Hudson ..... F01D 5/3007 415/208.1
2010/0061862 A1* 3/2010 Bonini ..... F01D 5/141 416/223 R
2010/0068048 A1* 3/2010 Spracher ..... F01D 5/141 415/208.2
2010/0092298 A1* 4/2010 Hudson ..... F01D 5/141 416/223 R
2012/0051929 A1* 3/2012 Blohm ..... F04D 29/324 416/223 A
2012/0063908 A1* 3/2012 Islam ..... F01D 5/141 416/223 A
2012/0219410 A1* 8/2012 Kathika ..... F04D 29/324 415/208.1
2012/0308395 A1* 12/2012 Shrum ..... F01D 5/141 416/241 R
2013/0064671 A1* 3/2013 Herzlinger ..... F01D 5/14 416/223 A
2013/0336779 A1* 12/2013 McKeever ..... F01D 5/141 415/208.1
2013/0336780 A1* 12/2013 McKeever ..... F04D 29/544 415/208.1
2013/0336798 A1* 12/2013 Dutka ..... F04D 29/324 416/223 R
2013/0336799 A1* 12/2013 Miller ..... F01D 5/141 416/241 R
2014/0000280 A1* 1/2014 Allen-Bradley ..... F01D 5/141 60/805
2014/0000281 A1* 1/2014 Nash ..... F01D 5/141 60/805
2014/0069110 A1* 3/2014 Good ..... F01D 5/14 60/805
2014/0123677 A1* 5/2014 Allen-Bradley ..... F01D 5/141 60/796
2016/0281509 A1* 9/2016 Pons ..... F01D 5/141
2017/0067352 A1* 3/2017 Deivernois ..... F04D 29/324
2017/0067353 A1* 3/2017 Blohm ..... F04D 29/544
2017/0067357 A1* 3/2017 Chiu ..... F01D 17/14
2017/0067358 A1* 3/2017 Subramaniyan ..... F01D 17/162
2017/0067475 A1* 3/2017 Chiu ..... F04D 29/324
2017/0067476 A1* 3/2017 Deivernois ..... F01D 9/041
2017/0067477 A1* 3/2017 Blohm ..... F01D 5/141
2017/0067478 A1* 3/2017 Schurr ..... F04D 29/324
2017/0067479 A1* 3/2017 Dutka ..... F04D 29/324
2017/0067482 A1* 3/2017 Valliappan ..... F04D 29/544
2017/0067483 A1* 3/2017 Dutka ..... F04D 29/563
2017/0198586 A1* 7/2017 Balzer ..... F01D 5/141
2018/0017070 A1* 1/2018 Dutka ..... F04D 29/324
2018/0017076 A1* 1/2018 Dutka ..... F01D 5/141
2018/0017077 A1* 1/2018 Delvernois ..... F04D 29/544
2019/0063228 A1* 2/2019 S ..... F01D 5/141
2019/0136696 A1* 5/2019 Dietrich ..... F01D 11/006
2019/0292913 A1* 9/2019 Zemitis ..... F01D 5/225
2020/0131911 A1* 4/2020 Pierre ..... F01D 9/041
2020/0131912 A1* 4/2020 Myers ..... F02C 3/04
2020/0157956 A1* 5/2020 Pierre ..... F01D 5/141
2020/0165918 A1* 5/2020 Walunj ..... F01D 5/066
2020/0232328 A1* 7/2020 Song ..... F01D 5/141
2021/0246792 A1* 8/2021 Ristau ..... F01D 5/141

* cited by examiner

AIRFOIL PROFILE

TECHNICAL FIELD

The present invention generally relates to axial compressor components having an airfoil. More specifically, the present invention relates to an airfoil profile for compressor components, such as blades and/or vanes, that have a variable thickness and three-dimensional ("3D") shape along the airfoil span in order to raise the natural frequency, improve airfoil mean stress and dynamic stress capabilities of the compressor component, and minimize risk of failure due to cracks caused by excitation of the component.

BACKGROUND

Gas turbine engines, such as those used for power generation or propulsion, include a compressor section. The compressor section includes a casing and a rotor that rotates about an axis within the casing. In axial-flow compressors, the rotor typically includes a plurality of rotor discs that rotate about the axis. A plurality of compressor blades extend away from, and are radially spaced around, an outer circumferential surface of each of the rotor discs. Typically, following each plurality of compressor blades is a plurality of compressor vanes. The plurality of compressor vanes usually extend from, and are radially spaced around, the casing. Each set of a rotor disc, a plurality of compressor blades extending from the rotor disc, and a plurality of compressor vanes immediately following the plurality of compressor blades is generally referred to as a compressor stage. The radial height of each successive compressor stage decreases because the blades and vanes increase the density, pressure and temperature of air passing through the stage. Specialized shapes of compressor blades and compressor vanes aid in compressing fluid as it passes through the compressor.

Compressor components, such as compressor blades and stator vanes, have an inherent natural frequency. When these components are excited by the passing air, as would occur during normal operating conditions of a gas turbine engine, the compressor components vibrate at different orders of engine rotational frequency. When the natural frequency of a compressor component coincides with or crosses an engine order, the compressor component can exhibit resonant vibration that in turn can cause cracking and ultimately failure of the compressor component.

SUMMARY

This summary is intended to introduce a selection of concepts in a simplified form that are further described below in the detailed description section of this disclosure. This summary is not intended to identify key or essential features of the claimed subject matter, nor is it intended to be used as an aid in isolation to determine the scope of the claimed subject matter.

In brief, and at a high level, this disclosure describes gas turbine engine components, e.g., compressor components such as blades and vanes, having airfoil portions that optimize the interaction with other compressor stages, provide for aerodynamic efficiency, and meet aeromechanical life objectives. More specifically, the compressor components described herein have unique airfoil thicknesses, chord lengths, and 3D shaping that results in the desired natural frequency of the respective compressor component. Further, the airfoil thicknesses and 3D shaping at specified radial distances along the airfoil span may provide an acceptable level of mean stress in the airfoil sections, and also provide improved vane aerodynamics and efficiency while maintaining the desired vane natural frequency. The airfoil portion of the compressor components disclosed herein, such as blades or vanes, have a particular shape or profile as specified herein. For example, one such airfoil profile may be defined by at least some of the Cartesian coordinate values of X, Y, and Z set forth in Table 1. In this example, the Z coordinate values are distances measured perpendicular to the compressor centerline and the X and Y coordinate values for each Z distance define an airfoil section when the coordinate values are connected with smooth continuing arcs. In this example, the airfoil sections at each Z distance are further joined with smooth continuing arcs to define the 3D shape of the airfoil portion of the compressor component.

BRIEF DESCRIPTION OF THE DRAWINGS

The embodiments disclosed herein relate to compressor component airfoil designs and are described in detail with reference to the attached drawing figures, which illustrate non-limiting examples of the disclosed subject matter, wherein.

DETAILED DESCRIPTION

The subject matter of this disclosure is described herein to meet statutory requirements. However, this description is not intended to limit the scope of the invention. Rather, the claimed subject matter may be embodied in other ways, to include different steps, combinations of steps, features, and/or combinations of features, similar to those described in this disclosure, and in conjunction with other present or future technologies.

In brief, and at a high level, this disclosure describes gas turbine engine components, e.g., compressor components such as blades and vanes, having airfoil portions that may optimize the interaction with other compressor stages, provide for aerodynamic efficiency, and improve aeromechanical life objectives. More specifically, the compressor components described herein may have, in different disclosed aspects, unique airfoil thicknesses, chord lengths, and 3D shaping that results in different performance characteristics being achieved, such as, e.g., an altered natural frequency of the associated compressor component. Further, the airfoil thicknesses and 3D shaping at specified radial distances along the airfoil span may provide an acceptable level of mean stress in the airfoil sections, and also provide improved vane aerodynamics and efficiency. The airfoil portion of the compressor components disclosed herein, such as blades or vanes, have a particular shape or profile as specified herein. For example, one such airfoil profile may be defined by the Cartesian coordinate values of X, Y, and Z set forth in Table 1. In this example, the Z coordinate values are distances measured perpendicular from the compressor centerline and the X and Y coordinate values at each Z distance define an airfoil section when the coordinate values are connected with smooth continuing arcs. In this example, the airfoil sections at each Z distance may be joined with smooth continuing arcs to define the 3D shape of the airfoil portion of the compressor component.

Figure 1:
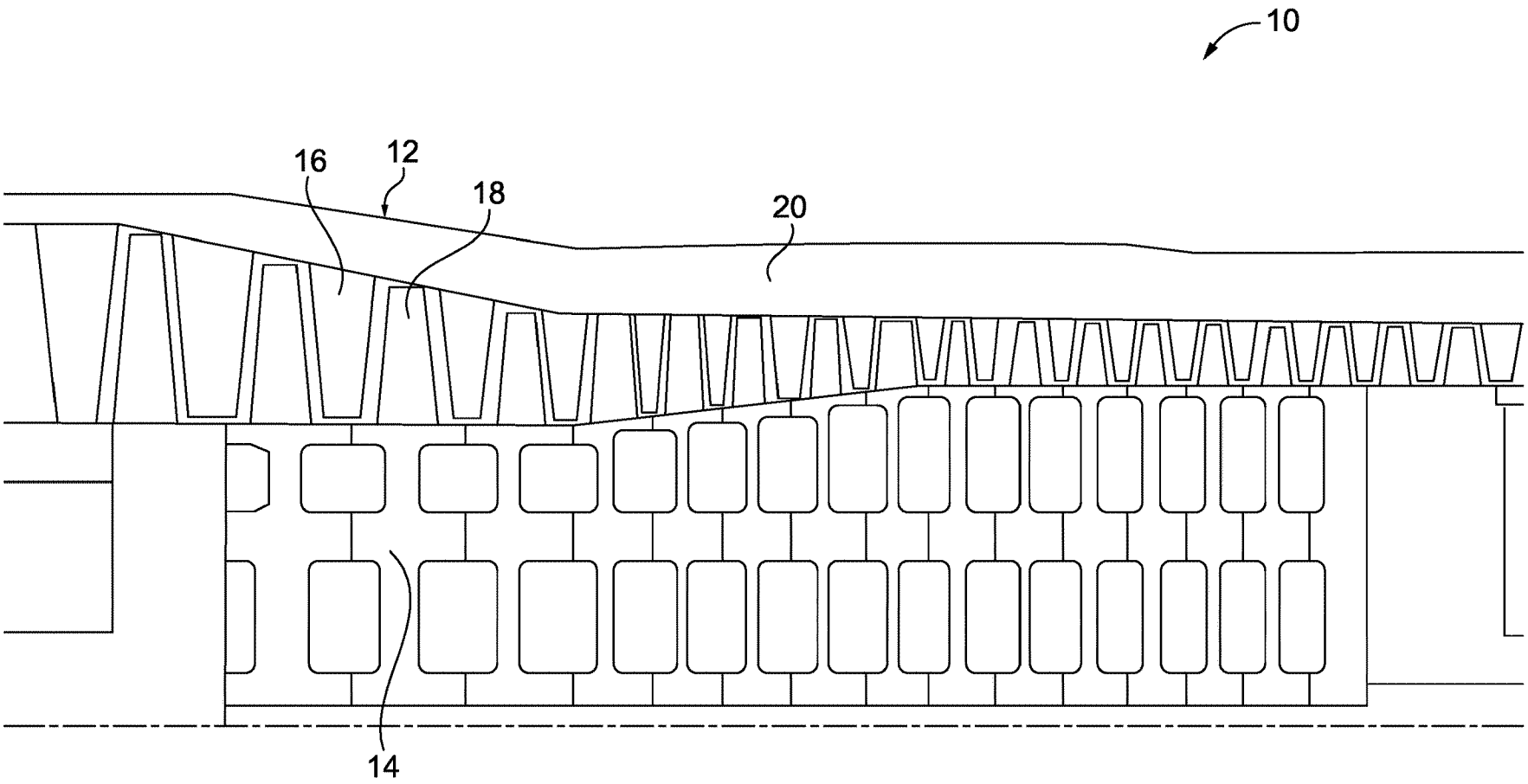
FIG. 1 depicts a schematic view of a gas turbine engine, in accordance with aspects hereof.
Figure 2:
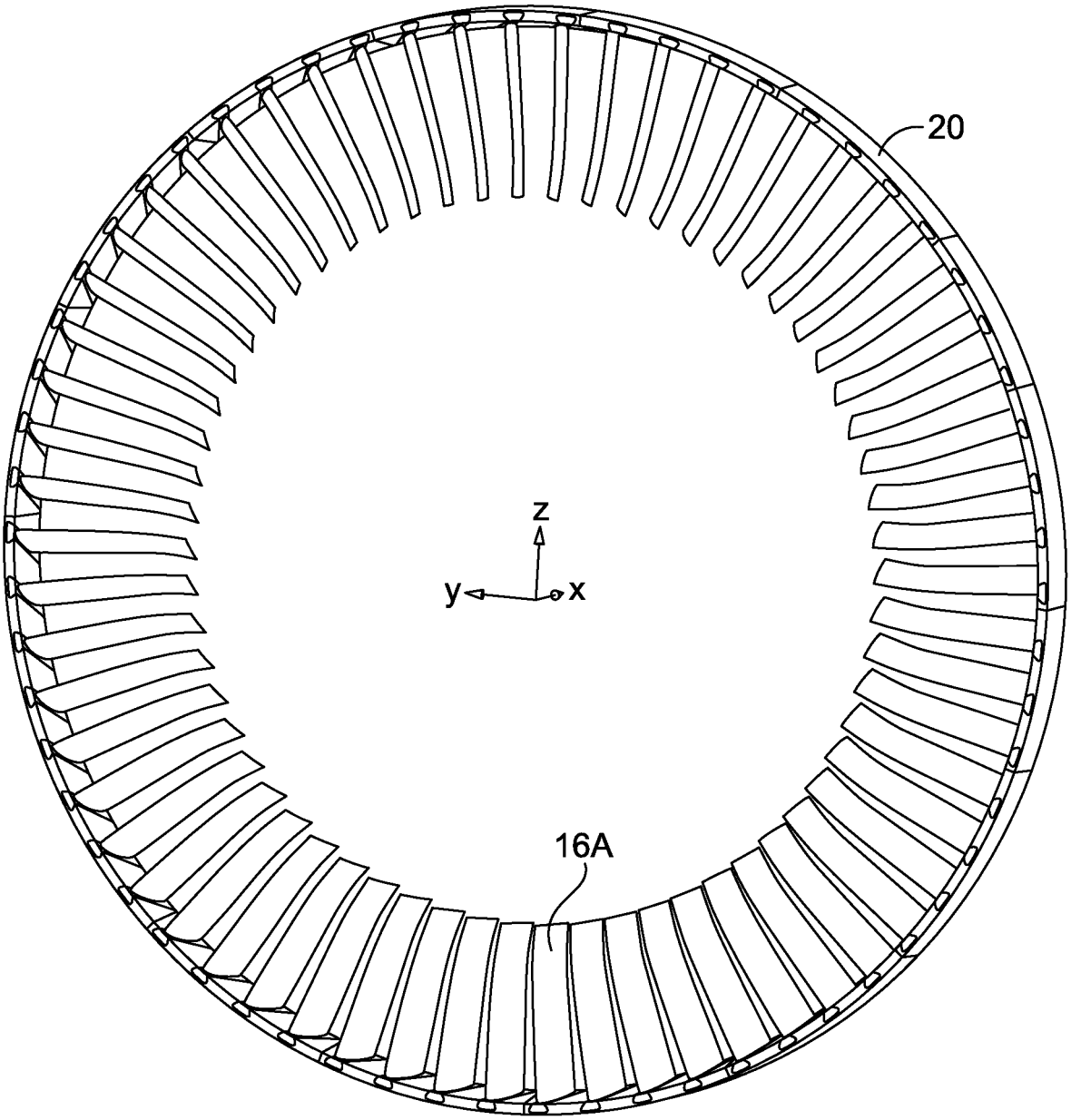
FIG. 2 depicts a perspective view of a set of compressor vanes coupled to a compressor casing, in accordance with aspects hereof.

Referring now to FIG. 1, there is illustrated a portion of a compressor 10 having multiple compressor stages, including a stage two 12 at the front of the compressor 10. Each compressor stage includes a rotor disc 14, a plurality of circumferentially spaced compressor blades 16 coupled to the rotor disc 14, and a plurality of compressor vanes 18 adjacent to, and following, the plurality of circumferentially spaced compressor blades 16. The plurality of compressor vanes 18 are circumferentially spaced around, and extend from, a casing 20 of the compressor 10.

Figure 3:
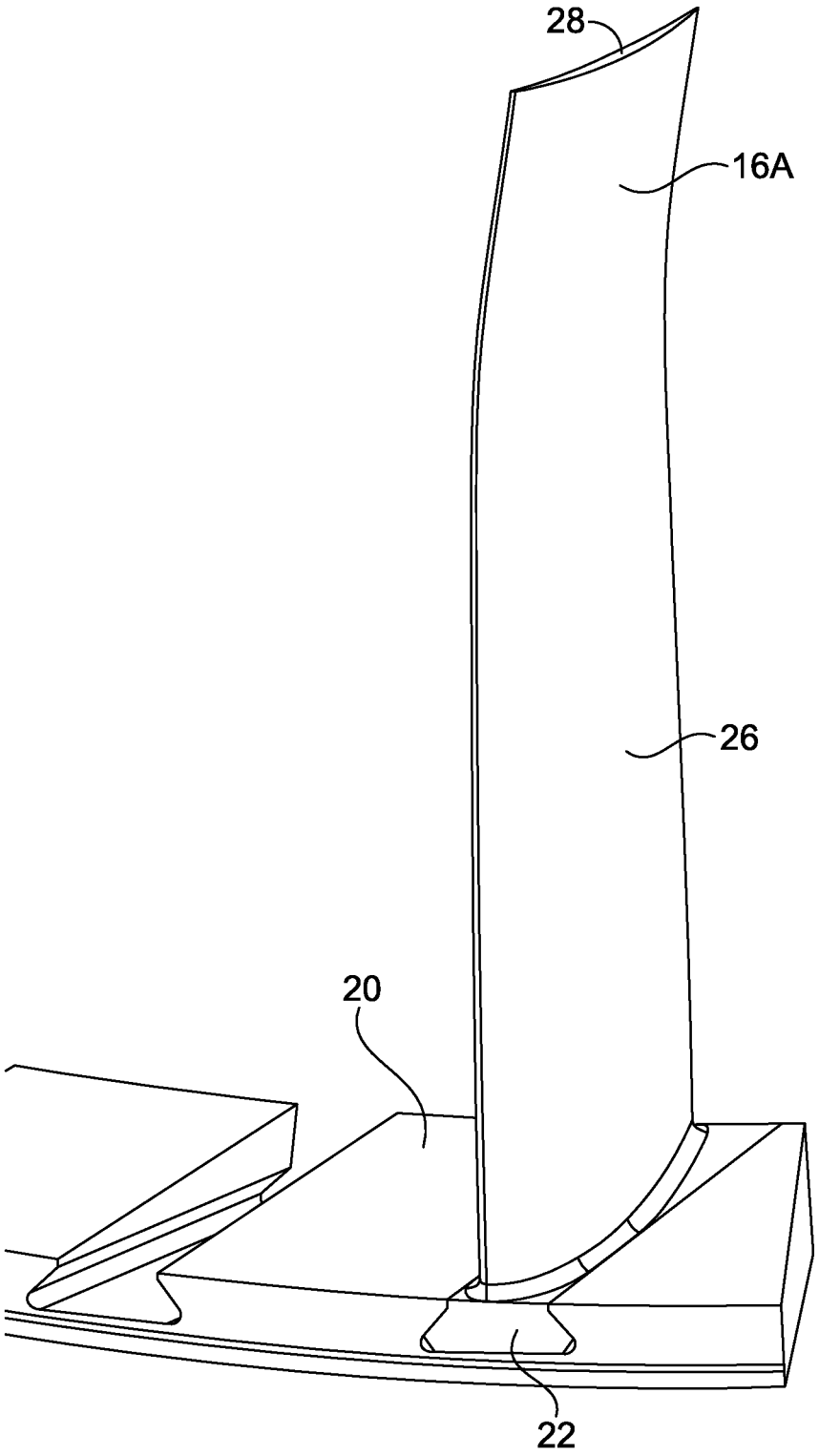
FIG. 3 depicts a perspective view of a portion of the compressor casing of FIG. 2 and a compressor vane coupled thereto, in accordance with aspects hereof.
Figure 4:
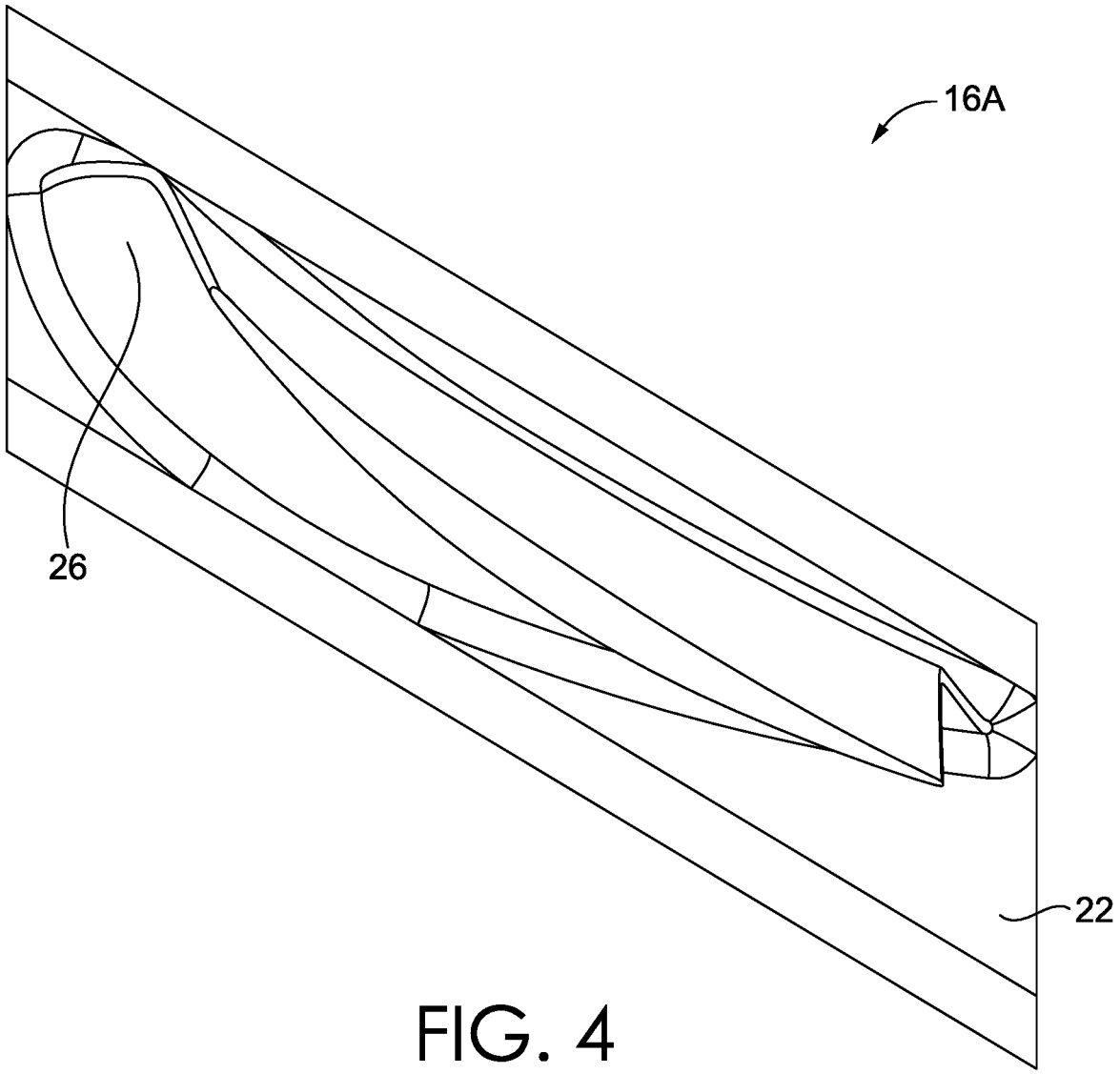
FIG. 4 depicts a top view of a compressor component, in accordance with aspects hereof.
Figure 5:
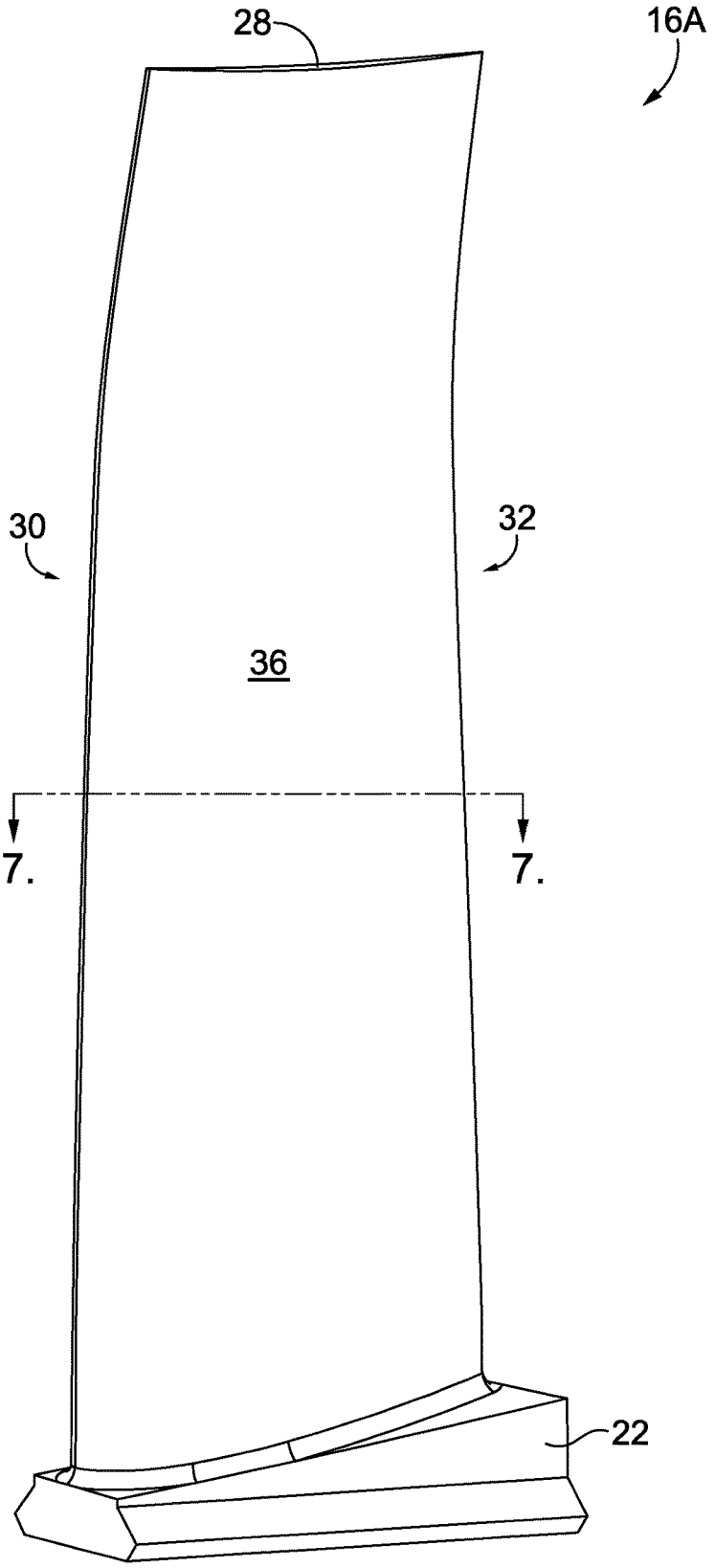
FIG. 5 depicts a perspective view of a pressure side of the compressor component of FIG. 4, in accordance with aspects hereof.
Figure 6:
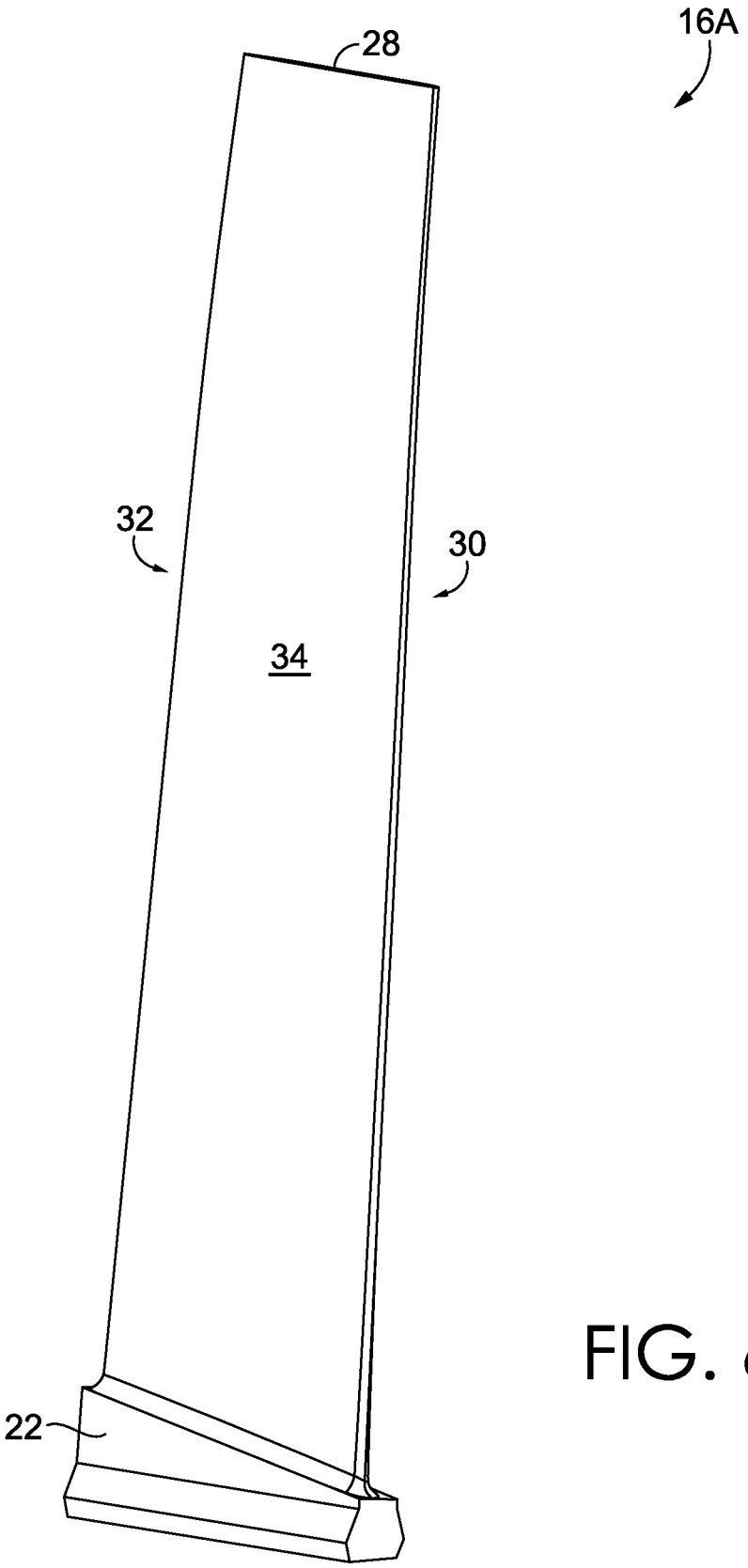
FIG. 6 depicts a perspective view of a suction side of the compressor component of FIG. 4, in accordance with aspects hereof.

One aspect of a compressor component is a compressor vane 16A, as depicted in FIGS. 2-6. As best seen in FIG. 3, the compressor vane 16A includes a root portion 22 configured to be coupled to the casing 20, and an airfoil portion 26 extending from the root portion 22 to a tip 28. As best seen in FIGS. 5 and 6, the airfoil portion 26 generally includes a leading edge 30, a trailing edge 32, and a pressure side wall 34 and a suction side wall 36 each extending between the leading edge 30 and the trailing edge 32. The pressure side wall 34 generally presents a convex surface along the span of the airfoil portion 26. The suction side wall 36 generally presents a concave surface along the span of the airfoil portion 26.

A compressor component may be used in a land-based compressor in connection with a land-based gas turbine engine. Typically, compressor components in such a compressor only experience temperatures below approximately 850 degrees Fahrenheit. As such, these types of compressor components may be fabricated from a relatively low temperature alloy. For example, these compressor components may be made from a stainless-steel alloy.

Figure 7:
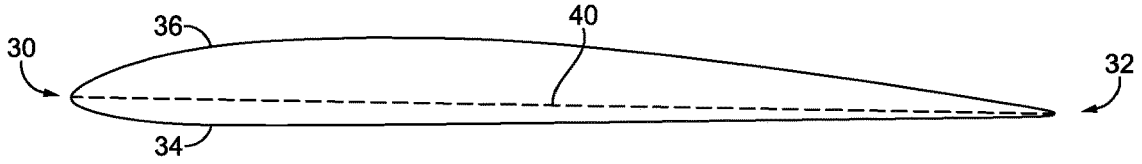
FIG. 7 depicts a cross-section of the compressor component of FIG. 4 taken along cut-line 7-7 in FIG. 5, in accordance with aspects hereof.

A cross-section of one aspect of the airfoil portion 26 is depicted in FIG. 7. As seen in FIG. 7, a chord 40 is shown for this radial section of the airfoil portion 26. The thickness of the airfoil portion 26 (e.g., the distance between the pressure side wall 34 and the suction side wall 36) varies at each point along the chord 40. As is evident from FIGS. 4-6, the length and orientation of the chord 40 changes along the span of the airfoil portion 26.

By changing the airfoil thickness, chord, 3D shaping, and/or the distribution of material along the span of the airfoil portion 26 of the compressor component, the natural frequency of the compressor component may be altered. This may be advantageous for the operation of the compressor 10. For example, during operation of the compressor 10, the compressor component may move (e.g., vibrate) at various modes due to the geometry, temperature, and aerodynamic forces being applied to the compressor component. These modes may include bending, torsion, and various higher-order modes.

If excitation of the compressor component occurs for a prolonged period of time with a sufficiently high amplitude then the compressor component can fail due to high cycle fatigue. For example, a critical first bending mode frequency for the compressor component may be approximately three times the 60 Hz rotation frequency of the gas turbine engine. For this mode, the first bending mode must avoid the critical frequency ranges of 110-130 Hz and 170-190 Hz. Modifying the thickness, chord, and/or the 3D shape of the compressor component, and in particular that of the airfoil portion thereof, results in altering the natural frequency of the compressor component. Continuing with the above example, modifying the thickness, chord, and/or the 3D shape of the compressor component in accordance with the disclosure herein may result in the first bending natural frequency being shifted to be between 125 Hz and 175 Hz, in accordance with some aspects. In other aspects, the first bening natural frequency may be shifted to be between about 130 Hz to about 170 Hz. This first bending natural frequency of the compressor component will therefore be between the $2^{nd}$ and $3^{rd}$ engine order excitation frequencies when the compressor is rotating at 60 Hz. More specifically, a compressor component having the thickness, chord, and/or the 3D shape as defined by the Cartesian coordinates set forth in Table 1 will have a natural frequency of first bending between $2^{nd}$ and $3^{rd}$ engine order excitations. In other aspects, a compressor component having the thickness, chord, and/or the 3D shape as defined by the Cartesian coordinates set forth in Table 1 will have a natural frequency of first bending at least 5-10% greater than $2^{nd}$ engine order excitations and at least 5-10% less than $3^{rd}$ engine order excitations. In fact, a compressor component having the thickness, chord, and/or the 3D shape as defined by the Cartesian coordinates set forth in Table 1 will have a natural frequency for the lowest few vibration modes of at least 5-10% less than or greater than each engine order excitation. For example, the compressor component may have a natural frequency 12% greater than the $2^{nd}$ engine order excitation, when the compressor is rotating at 60 Hz.

Figure 8:
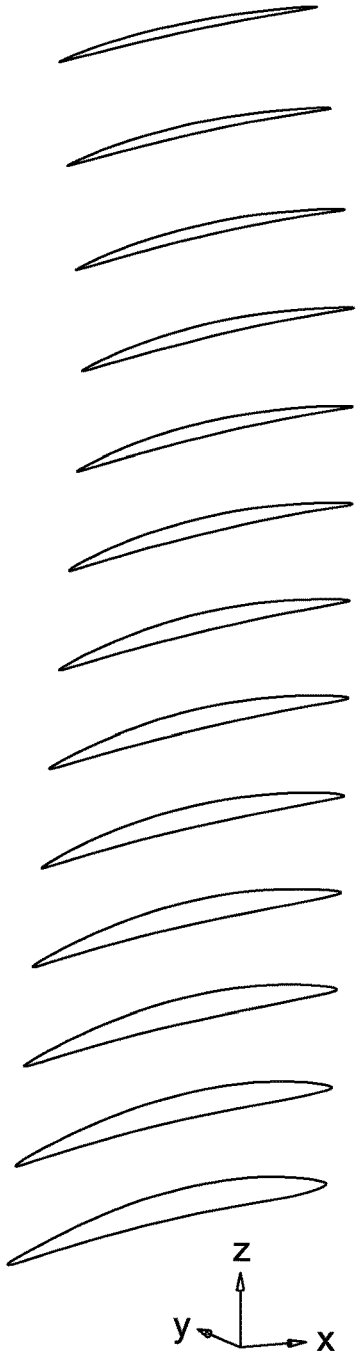
FIG. 8 depicts a perspective view of the airfoil sections defined by the Cartesian coordinate values of X, Y, and Z set forth in Table 1, in accordance with aspects hereof.

In one embodiment disclosed herein, a nominal 3D shape of an airfoil portion, such as the airfoil portion 26 shown in FIGS. 5 and 6, of a gas turbine engine component, such as a compressor component of a gas turbine engine, may be defined by a set of X, Y, and Z coordinate values measured in a Cartesian coordinate system. For example, one such set of coordinate values are set forth, in inches, in Table 1 below. The Cartesian coordinate system includes orthogonally related X, Y, and Z axes. The positive X, Y, and Z directions are axial toward the exhaust end of the compressor, tangential in the direction of engine rotation, and radially outward toward the static case, respectively. Each Z distance is measured from an axially-extending centerline of the compressor 10 (which, in aspects, may also be a centerline of the gas turbine engine). The X and Y coordinates for each distance Z may be joined smoothly (e.g., such as by smooth continuing arcs, splines, or the like) to thereby define a section of the airfoil portion of the compressor component at the respective Z distance. Each of the sections of the airfoil portion from the coordinate values set forth in Table 1 below is shown in FIG. 8. Each of the defined sections of the airfoil profile is joined smoothly with an adjacent section of the airfoil profile in the Z direction to form a complete nominal 3D shape of the airfoil portion.

The coordinate values set forth in Table 1 below are for a cold condition of the compressor component (e.g., non-rotating state and at room temperature). Further, the coordinate values set forth in Table 1 below are for an uncoated nominal 3D shape of the compressor component. In some aspects, a coating (e.g., corrosion protective coating) may be applied to the compressor component. The coating thickness may be up to about 0.010 inches thick.

Further, the compressor component may be fabricated using a variety of manufacturing techniques, such as forging, casting, milling, electro-chemical machining, electric-discharge machining, and the like. As such, the compressor component may have a series of manufacturing tolerances for the position, profile, twist, and chord that can cause the compressor component to vary from the nominal 3D shape defined by the coordinate values set forth in Table 1. This manufacturing tolerance may be, for example, +/−0.120 inches in a direction away from any of the coordinate values of Table 1 without departing from the scope of the subject matter described herein. In other aspects, the manufacturing tolerances may be +/−0.080 inches. In still other aspects, the manufacturing tolerances may be +/−0.020 inches.

In addition to manufacturing tolerances affecting the overall size of the compressor component, it is also possible to scale the airfoil to a larger or smaller airfoil size. In order to maintain the benefits of this 3D shape, in terms of stiffness and stress, it is necessary to scale the compressor component uniformly in the X, Y, and Z directions. However, since the Z values in Table 1 are measured from a centerline of the compressor rather than a point on the compressor component, the scaling of the Z values must be relative to the minimum Z value in Table 1. For example, the first (i.e., radially innermost) profile section is positioned approximately 24.400 inches from the compressor centerline and the second profile section is positioned approximately 25.350 inches from the engine centerline. Thus, if the compressor component was to be scaled 20% larger, each of the X and Y values in Table 1 may simply be multiplied by 1.2. However, each of the Z values must first be adjusted to a relative scale by subtracting the distance from the compressor centerline to the first profile section (e.g., the Z coordinates for the first profile section become Z=0, the Z coordinates for the second profile section become Z=0.950 inches, etc.). This adjustment creates a nominal Z value. After this adjustment, then the nominal Z values may be multiplied by the same constant or number as were the X and Y coordinates (1.2 in this example).

The Z values set forth in Table 1 may assume a compressor sized to operate at 60 Hz. In other aspects, the compressor component described herein may also be used in different size compressors (e.g., a compressor sized to operate at 50 Hz, etc.). In these aspects, the compressor component defined by the X, Y, and Z values set forth in Table 1 may still be used, however, the Z values would be offset to account for the radial spacing of the differently sized compressors and components thereof (e.g., rotors, discs, blades, casing, etc.). The Z values may be offset radially inwardly or radially outwardly, depending upon whether the compressor is smaller or larger than the compressor envisioned by Table 1. For example, the casing to which a vane is affixed may spaced farther from the compressor centerline (e.g., 20%) than that envisioned by Table 1. In such a case, the minimum Z values (i.e., the radially innermost profile section) would be offset a distance equal to the difference in casing size (e.g., the radially innermost profile section would be positioned approximately 29.280 inches from the engine centerline instead of 24.400 inches) and the remainder of the Z values would maintain their relative spacing to one another from Table 1 with the same scale factor as being applied to X and Y (e.g., if the scale factor is one then the second profile section would be positioned approximately 30.230 inches from the engine centerline—still 0.950 inches radially outward from the first profile section). Stated another way, the difference in spacing of the casing from the centerline would be added to all of the scaled Z values in Table 1.

Equation (1) provides another way to determine new Z values (e.g., scaled or translated) from the Z values listed in Table 1 when changing the relative size and/or position of the component defined by Table 1. In equation (1), $Z_1$ is the Z value from Table 1, $Z_{1\ min}$ is the minimum Z value from Table 1, scale is the scaling factor, $Z_{2min}$ is the minimum Z value of the component as scaled and/or translated, and $Z_2$ is the resultant Z value for the component as scaled and/or translated. Of note, when merely translating the component, the scaling factor in equation (1) is 1.00.

$$Z_2=[(Z_1-Z_{1\ min})*\text{scale}+Z_{2\ min}] \quad (1)$$

In yet another aspect, the airfoil profile may be defined by a portion of the set of X, Y, and Z coordinate values set forth in Table 1 (e.g., at least 85% of said coordinate values).

TABLE 1

| X | Y | Z |
|---|---|---|
| 1.310 | 0.742 | 24.400 |
| 1.251 | 0.714 | 24.400 |
| 1.192 | 0.685 | 24.400 |
| 1.134 | 0.655 | 24.400 |
| 1.076 | 0.626 | 24.400 |
| 1.018 | 0.595 | 24.400 |
| 0.960 | 0.565 | 24.400 |
| 0.903 | 0.533 | 24.400 |
| 0.846 | 0.502 | 24.400 |
| 0.789 | 0.470 | 24.400 |
| 0.733 | 0.437 | 24.400 |
| 0.676 | 0.404 | 24.400 |
| 0.620 | 0.371 | 24.400 |
| 0.564 | 0.338 | 24.400 |
| 0.508 | 0.304 | 24.400 |
| 0.452 | 0.270 | 24.400 |
| 0.397 | 0.235 | 24.400 |
| 0.342 | 0.201 | 24.400 |
| 0.287 | 0.166 | 24.400 |
| 0.232 | 0.130 | 24.400 |
| 0.177 | 0.095 | 24.400 |
| 0.122 | 0.059 | 24.400 |
| 0.067 | 0.024 | 24.400 |
| 0.013 | −0.012 | 24.400 |
| −0.041 | −0.048 | 24.400 |
| −0.096 | −0.085 | 24.400 |
| −0.150 | −0.121 | 24.400 |
| −0.203 | −0.158 | 24.400 |
| −0.257 | −0.196 | 24.400 |
| −0.310 | −0.234 | 24.400 |
| −0.362 | −0.273 | 24.400 |
| −0.414 | −0.312 | 24.400 |
| −0.466 | −0.352 | 24.400 |
| −0.517 | −0.393 | 24.400 |
| −0.568 | −0.434 | 24.400 |
| −0.618 | −0.476 | 24.400 |
| −0.667 | −0.519 | 24.400 |
| −0.716 | −0.562 | 24.400 |
| −0.764 | −0.606 | 24.400 |
| −0.812 | −0.651 | 24.400 |
| −0.859 | −0.696 | 24.400 |
| −0.905 | −0.742 | 24.400 |
| −0.950 | −0.789 | 24.400 |
| −0.960 | −0.798 | 24.400 |
| −0.965 | −0.802 | 24.400 |
| −0.969 | −0.805 | 24.400 |
| −0.974 | −0.807 | 24.400 |
| −0.979 | −0.809 | 24.400 |
| −0.985 | −0.810 | 24.400 |
| −0.990 | −0.809 | 24.400 |
| −0.994 | −0.806 | 24.400 |
| −0.996 | −0.800 | 24.400 |

TABLE 1-continued

| X | Y | Z |
|---|---|---|
| −0.996 | −0.795 | 24.400 |
| −0.995 | −0.789 | 24.400 |
| −0.993 | −0.784 | 24.400 |
| −0.991 | −0.779 | 24.400 |
| −0.988 | −0.774 | 24.400 |
| −0.981 | −0.762 | 24.400 |
| −0.940 | −0.710 | 24.400 |
| −0.898 | −0.658 | 24.400 |
| −0.856 | −0.607 | 24.400 |
| −0.813 | −0.556 | 24.400 |
| −0.770 | −0.505 | 24.400 |
| −0.725 | −0.456 | 24.400 |
| −0.680 | −0.407 | 24.400 |
| −0.634 | −0.359 | 24.400 |
| −0.588 | −0.311 | 24.400 |
| −0.540 | −0.265 | 24.400 |
| −0.492 | −0.219 | 24.400 |
| −0.443 | −0.174 | 24.400 |
| −0.393 | −0.130 | 24.400 |
| −0.343 | −0.086 | 24.400 |
| −0.291 | −0.044 | 24.400 |
| −0.239 | −0.003 | 24.400 |
| −0.186 | 0.038 | 24.400 |
| −0.133 | 0.077 | 24.400 |
| −0.079 | 0.116 | 24.400 |
| −0.024 | 0.154 | 24.400 |
| 0.032 | 0.190 | 24.400 |
| 0.088 | 0.226 | 24.400 |
| 0.144 | 0.261 | 24.400 |
| 0.202 | 0.295 | 24.400 |
| 0.259 | 0.328 | 24.400 |
| 0.317 | 0.361 | 24.400 |
| 0.376 | 0.392 | 24.400 |
| 0.435 | 0.423 | 24.400 |
| 0.495 | 0.452 | 24.400 |
| 0.555 | 0.481 | 24.400 |
| 0.615 | 0.509 | 24.400 |
| 0.676 | 0.536 | 24.400 |
| 0.737 | 0.562 | 24.400 |
| 0.799 | 0.588 | 24.400 |
| 0.861 | 0.612 | 24.400 |
| 0.923 | 0.636 | 24.400 |
| 0.985 | 0.659 | 24.400 |
| 1.048 | 0.681 | 24.400 |
| 1.111 | 0.703 | 24.400 |
| 1.174 | 0.724 | 24.400 |
| 1.237 | 0.744 | 24.400 |
| 1.301 | 0.763 | 24.400 |
| 1.315 | 0.767 | 24.400 |
| 1.317 | 0.767 | 24.400 |
| 1.319 | 0.767 | 24.400 |
| 1.321 | 0.766 | 24.400 |
| 1.323 | 0.765 | 24.400 |
| 1.325 | 0.764 | 24.400 |
| 1.326 | 0.762 | 24.400 |
| 1.327 | 0.760 | 24.400 |
| 1.328 | 0.757 | 24.400 |
| 1.327 | 0.755 | 24.400 |
| 1.327 | 0.753 | 24.400 |
| 1.325 | 0.751 | 24.400 |
| 1.324 | 0.749 | 24.400 |
| 1.322 | 0.748 | 24.400 |
| 1.304 | 0.594 | 25.350 |
| 1.065 | 0.479 | 25.350 |
| 0.830 | 0.356 | 25.350 |
| 0.599 | 0.227 | 25.350 |
| 0.370 | 0.093 | 25.350 |
| 0.144 | −0.045 | 25.350 |
| −0.080 | −0.187 | 25.350 |
| −0.301 | −0.334 | 25.350 |
| −0.515 | −0.490 | 25.350 |
| −0.722 | −0.656 | 25.350 |
| −0.920 | −0.832 | 25.350 |
| −1.030 | −0.937 | 25.350 |
| −1.050 | −0.946 | 25.350 |
| −1.061 | −0.930 | 25.350 |
| −1.054 | −0.909 | 25.350 |
| −0.922 | −0.736 | 25.350 |

TABLE 1-continued

| X | Y | Z |
|---|---|---|
| −0.744 | −0.531 | 25.350 |
| −0.552 | −0.340 | 25.350 |
| −0.346 | −0.163 | 25.350 |
| −0.127 | −0.003 | 25.350 |
| 0.103 | 0.141 | 25.350 |
| 0.341 | 0.271 | 25.350 |
| 0.588 | 0.384 | 25.350 |
| 0.841 | 0.482 | 25.350 |
| 1.099 | 0.565 | 25.350 |
| 1.309 | 0.622 | 25.350 |
| 1.319 | 0.619 | 25.350 |
| 1.323 | 0.611 | 25.350 |
| 1.319 | 0.602 | 25.350 |
| 1.244 | 0.567 | 25.350 |
| 1.006 | 0.449 | 25.350 |
| 0.772 | 0.325 | 25.350 |
| 0.541 | 0.194 | 25.350 |
| 0.313 | 0.059 | 25.350 |
| 0.088 | −0.080 | 25.350 |
| −0.136 | −0.223 | 25.350 |
| −0.355 | −0.372 | 25.350 |
| −0.568 | −0.530 | 25.350 |
| −0.772 | −0.699 | 25.350 |
| −0.968 | −0.878 | 25.350 |
| −1.034 | −0.940 | 25.350 |
| −1.056 | −0.945 | 25.350 |
| −1.060 | −0.925 | 25.350 |
| −1.046 | −0.897 | 25.350 |
| −0.878 | −0.684 | 25.350 |
| −0.697 | −0.482 | 25.350 |
| −0.501 | −0.294 | 25.350 |
| −0.292 | −0.122 | 25.350 |
| −0.070 | 0.034 | 25.350 |
| 0.162 | 0.175 | 25.350 |
| 0.402 | 0.300 | 25.350 |
| 0.650 | 0.410 | 25.350 |
| 0.905 | 0.504 | 25.350 |
| 1.164 | 0.584 | 25.350 |
| 1.312 | 0.622 | 25.350 |
| 1.320 | 0.618 | 25.350 |
| 1.323 | 0.608 | 25.350 |
| 1.317 | 0.601 | 25.350 |
| 1.184 | 0.538 | 25.350 |
| 0.947 | 0.418 | 25.350 |
| 0.714 | 0.292 | 25.350 |
| 0.484 | 0.161 | 25.350 |
| 0.257 | 0.025 | 25.350 |
| 0.032 | −0.115 | 25.350 |
| −0.191 | −0.259 | 25.350 |
| −0.409 | −0.410 | 25.350 |
| −0.620 | −0.571 | 25.350 |
| −0.822 | −0.742 | 25.350 |
| −1.015 | −0.925 | 25.350 |
| −1.039 | −0.943 | 25.350 |
| −1.060 | −0.941 | 25.350 |
| −1.058 | −0.919 | 25.350 |
| −1.005 | −0.843 | 25.350 |
| −0.834 | −0.632 | 25.350 |
| −0.649 | −0.434 | 25.350 |
| −0.450 | −0.250 | 25.350 |
| −0.238 | −0.081 | 25.350 |
| −0.013 | 0.071 | 25.350 |
| 0.221 | 0.208 | 25.350 |
| 0.464 | 0.329 | 25.350 |
| 0.713 | 0.435 | 25.350 |
| 0.969 | 0.526 | 25.350 |
| 1.229 | 0.602 | 25.350 |
| 1.314 | 0.622 | 25.350 |
| 1.322 | 0.616 | 25.350 |
| 1.322 | 0.606 | 25.350 |
| 1.125 | 0.508 | 25.350 |
| 0.889 | 0.388 | 25.350 |
| 0.656 | 0.260 | 25.350 |
| 0.427 | 0.127 | 25.350 |
| 0.200 | −0.010 | 25.350 |
| −0.024 | −0.151 | 25.350 |
| −0.246 | −0.296 | 25.350 |
| −0.462 | −0.450 | 25.350 |

TABLE 1-continued

| X | Y | Z |
|---|---|---|
| −0.671 | −0.613 | 25.350 |
| −0.871 | −0.787 | 25.350 |
| −1.025 | −0.934 | 25.350 |
| −1.045 | −0.945 | 25.350 |
| −1.062 | −0.936 | 25.350 |
| −1.056 | −0.914 | 25.350 |
| −0.964 | −0.789 | 25.350 |
| −0.790 | −0.581 | 25.350 |
| −0.601 | −0.386 | 25.350 |
| −0.398 | −0.206 | 25.350 |
| −0.183 | −0.042 | 25.350 |
| 0.044 | 0.107 | 25.350 |
| 0.281 | 0.240 | 25.350 |
| 0.525 | 0.357 | 25.350 |
| 0.777 | 0.459 | 25.350 |
| 1.034 | 0.546 | 25.350 |
| 1.295 | 0.618 | 25.350 |
| 1.317 | 0.621 | 25.350 |
| 1.323 | 0.613 | 25.350 |
| 1.321 | 0.604 | 25.350 |
| 1.302 | 0.464 | 26.300 |
| 1.058 | 0.348 | 26.300 |
| 0.818 | 0.225 | 26.300 |
| 0.581 | 0.096 | 26.300 |
| 0.347 | −0.039 | 26.300 |
| 0.115 | −0.178 | 26.300 |
| −0.115 | −0.320 | 26.300 |
| −0.342 | −0.466 | 26.300 |
| −0.563 | −0.622 | 26.300 |
| −0.775 | −0.789 | 26.300 |
| −0.979 | −0.967 | 26.300 |
| −1.091 | −1.073 | 26.300 |
| −1.113 | −1.082 | 26.300 |
| −1.124 | −1.066 | 26.300 |
| −1.116 | −1.044 | 26.300 |
| −0.983 | −0.866 | 26.300 |
| −0.803 | −0.655 | 26.300 |
| −0.607 | −0.459 | 26.300 |
| −0.397 | −0.278 | 26.300 |
| −0.172 | −0.116 | 26.300 |
| 0.064 | 0.029 | 26.300 |
| 0.310 | 0.157 | 26.300 |
| 0.564 | 0.268 | 26.300 |
| 0.825 | 0.362 | 26.300 |
| 1.091 | 0.441 | 26.300 |
| 1.308 | 0.493 | 26.300 |
| 1.317 | 0.490 | 26.300 |
| 1.322 | 0.481 | 26.300 |
| 1.317 | 0.471 | 26.300 |
| 1.315 | 0.470 | 26.300 |
| 1.241 | 0.436 | 26.300 |
| 0.998 | 0.318 | 26.300 |
| 0.758 | 0.193 | 26.300 |
| 0.522 | 0.062 | 26.300 |
| 0.288 | −0.073 | 26.300 |
| 0.057 | −0.213 | 26.300 |
| −0.172 | −0.356 | 26.300 |
| −0.398 | −0.504 | 26.300 |
| −0.617 | −0.663 | 26.300 |
| −0.827 | −0.832 | 26.300 |
| −1.028 | −1.013 | 26.300 |
| −1.096 | −1.076 | 26.300 |
| −1.118 | −1.081 | 26.300 |
| −1.123 | −1.060 | 26.300 |
| −1.109 | −1.032 | 26.300 |
| −0.940 | −0.812 | 26.300 |
| −0.755 | −0.605 | 26.300 |
| −0.556 | −0.412 | 26.300 |
| −0.342 | −0.236 | 26.300 |
| −0.114 | −0.078 | 26.300 |
| 0.125 | 0.063 | 26.300 |
| 0.373 | 0.187 | 26.300 |
| 0.629 | 0.293 | 26.300 |
| 0.891 | 0.383 | 26.300 |
| 1.158 | 0.458 | 26.300 |
| 1.310 | 0.493 | 26.300 |
| 1.319 | 0.488 | 26.300 |
| 1.321 | 0.478 | 26.300 |

TABLE 1-continued

| X | Y | Z |
|---|---|---|
| 1.180 | 0.407 | 26.300 |
| 0.938 | 0.287 | 26.300 |
| 0.699 | 0.161 | 26.300 |
| 0.463 | 0.029 | 26.300 |
| 0.230 | −0.108 | 26.300 |
| 0.000 | −0.248 | 26.300 |
| −0.229 | −0.392 | 26.300 |
| −0.453 | −0.543 | 26.300 |
| −0.670 | −0.704 | 26.300 |
| −0.878 | −0.876 | 26.300 |
| −1.076 | −1.060 | 26.300 |
| −1.101 | −1.079 | 26.300 |
| −1.123 | −1.077 | 26.300 |
| −1.121 | −1.055 | 26.300 |
| −1.068 | −0.976 | 26.300 |
| −0.895 | −0.759 | 26.300 |
| −0.707 | −0.555 | 26.300 |
| −0.504 | −0.366 | 26.300 |
| −0.286 | −0.195 | 26.300 |
| −0.055 | −0.041 | 26.300 |
| 0.186 | 0.096 | 26.300 |
| 0.436 | 0.215 | 26.300 |
| 0.694 | 0.317 | 26.300 |
| 0.958 | 0.403 | 26.300 |
| 1.226 | 0.474 | 26.300 |
| 1.313 | 0.492 | 26.300 |
| 1.321 | 0.486 | 26.300 |
| 1.321 | 0.476 | 26.300 |
| 1.119 | 0.378 | 26.300 |
| 0.878 | 0.256 | 26.300 |
| 0.640 | 0.128 | 26.300 |
| 0.405 | −0.005 | 26.300 |
| 0.172 | −0.143 | 26.300 |
| −0.058 | −0.284 | 26.300 |
| −0.286 | −0.429 | 26.300 |
| −0.508 | −0.582 | 26.300 |
| −0.723 | −0.746 | 26.300 |
| −0.929 | −0.921 | 26.300 |
| −1.087 | −1.070 | 26.300 |
| −1.107 | −1.081 | 26.300 |
| −1.124 | −1.071 | 26.300 |
| −1.119 | −1.049 | 26.300 |
| −1.026 | −0.920 | 26.300 |
| −0.849 | −0.707 | 26.300 |
| −0.658 | −0.506 | 26.300 |
| −0.451 | −0.322 | 26.300 |
| −0.229 | −0.155 | 26.300 |
| 0.004 | −0.005 | 26.300 |
| 0.248 | 0.127 | 26.300 |
| 0.500 | 0.242 | 26.300 |
| 0.759 | 0.340 | 26.300 |
| 1.024 | 0.423 | 26.300 |
| 1.293 | 0.489 | 26.300 |
| 1.315 | 0.491 | 26.300 |
| 1.321 | 0.483 | 26.300 |
| 1.319 | 0.473 | 26.300 |
| 1.303 | 0.403 | 27.250 |
| 1.240 | 0.375 | 27.250 |
| 0.686 | 0.096 | 27.250 |
| 0.149 | −0.215 | 27.250 |
| −0.146 | −0.394 | 27.250 |
| −0.204 | −0.430 | 27.250 |
| −0.716 | −0.780 | 27.250 |
| −1.143 | −1.152 | 27.250 |
| −1.170 | −1.165 | 27.250 |
| −1.176 | −1.164 | 27.250 |
| −1.125 | −1.055 | 27.250 |
| −0.709 | −0.571 | 27.250 |
| −0.444 | −0.336 | 27.250 |
| −0.388 | −0.292 | 27.250 |
| 0.155 | 0.044 | 27.250 |
| 0.745 | 0.285 | 27.250 |
| 1.086 | 0.383 | 27.250 |
| 1.155 | 0.399 | 27.250 |
| 1.322 | 0.426 | 27.250 |
| 1.053 | 0.287 | 27.250 |
| 0.991 | 0.256 | 27.250 |
| 0.446 | −0.039 | 27.250 |

TABLE 1-continued

| X | Y | Z |
|---|---|---|
| −0.087 | −0.358 | 27.250 |
| −0.379 | −0.541 | 27.250 |
| −0.436 | −0.579 | 27.250 |
| −0.930 | −0.955 | 27.250 |
| −1.164 | −1.164 | 27.250 |
| −1.182 | −1.148 | 27.250 |
| −1.181 | −1.142 | 27.250 |
| −0.950 | −0.832 | 27.250 |
| −0.499 | −0.380 | 27.250 |
| −0.214 | −0.170 | 27.250 |
| −0.154 | −0.131 | 27.250 |
| 0.413 | 0.162 | 27.250 |
| 1.018 | 0.365 | 27.250 |
| 1.308 | 0.433 | 27.250 |
| 1.311 | 0.434 | 27.250 |
| 1.322 | 0.415 | 27.250 |
| 1.115 | 0.317 | 27.250 |
| 0.807 | 0.162 | 27.250 |
| 0.746 | 0.129 | 27.250 |
| 0.208 | −0.179 | 27.250 |
| −0.321 | −0.504 | 27.250 |
| −0.606 | −0.698 | 27.250 |
| −0.661 | −0.739 | 27.250 |
| −1.132 | −1.142 | 27.250 |
| −1.182 | −1.154 | 27.250 |
| −1.174 | −1.125 | 27.250 |
| −1.166 | −1.112 | 27.250 |
| −0.759 | −0.621 | 27.250 |
| −0.272 | −0.209 | 27.250 |
| 0.029 | −0.023 | 27.250 |
| 0.092 | 0.011 | 27.250 |
| 0.678 | 0.262 | 27.250 |
| 1.294 | 0.430 | 27.250 |
| 1.319 | 0.430 | 27.250 |
| 1.321 | 0.428 | 27.250 |
| 0.868 | 0.194 | 27.250 |
| 0.565 | 0.029 | 27.250 |
| 0.505 | −0.005 | 27.250 |
| −0.028 | −0.322 | 27.250 |
| −0.550 | −0.658 | 27.250 |
| −0.824 | −0.866 | 27.250 |
| −0.878 | −0.910 | 27.250 |
| −1.158 | −1.162 | 27.250 |
| −1.177 | −1.131 | 27.250 |
| −1.039 | −0.942 | 27.250 |
| −0.995 | −0.886 | 27.250 |
| −0.553 | −0.426 | 27.250 |
| −0.033 | −0.057 | 27.250 |
| 0.283 | 0.105 | 27.250 |
| 0.347 | 0.134 | 27.250 |
| 0.949 | 0.346 | 27.250 |
| 1.317 | 0.432 | 27.250 |
| 1.324 | 0.420 | 27.250 |
| 1.323 | 0.418 | 27.250 |
| 1.177 | 0.346 | 27.250 |
| 0.625 | 0.063 | 27.250 |
| 0.327 | −0.109 | 27.250 |
| 0.267 | −0.144 | 27.250 |
| −0.263 | −0.467 | 27.250 |
| −0.771 | −0.823 | 27.250 |
| −1.032 | −1.047 | 27.250 |
| −1.083 | −1.094 | 27.250 |
| −1.180 | −1.160 | 27.250 |
| −1.082 | −0.998 | 27.250 |
| −0.856 | −0.725 | 27.250 |
| −0.808 | −0.673 | 27.250 |
| −0.330 | −0.250 | 27.250 |
| 0.218 | 0.075 | 27.250 |
| 0.544 | 0.214 | 27.250 |
| 0.611 | 0.239 | 27.250 |
| 1.224 | 0.415 | 27.250 |
| 1.323 | 0.423 | 27.250 |
| 1.319 | 0.410 | 27.250 |
| 1.316 | 0.409 | 27.250 |
| 0.929 | 0.225 | 27.250 |
| 0.386 | −0.074 | 27.250 |
| 0.090 | −0.250 | 27.250 |
| 0.031 | −0.286 | 27.250 |

TABLE 1-continued

| X | Y | Z |
|---|---|---|
| −0.493 | −0.618 | 27.250 |
| −0.982 | −1.000 | 27.250 |
| −1.148 | −1.156 | 27.250 |
| −1.153 | −1.159 | 27.250 |
| −1.179 | −1.136 | 27.250 |
| −0.903 | −0.778 | 27.250 |
| −0.658 | −0.522 | 27.250 |
| −0.606 | −0.473 | 27.250 |
| −0.094 | −0.094 | 27.250 |
| 0.478 | 0.189 | 27.250 |
| 0.813 | 0.306 | 27.250 |
| 0.881 | 0.327 | 27.250 |
| 1.314 | 0.433 | 27.250 |
| 1.321 | 0.412 | 27.250 |
| 1.315 | 0.414 | 28.200 |
| 1.251 | 0.386 | 28.200 |
| 0.684 | 0.101 | 28.200 |
| 0.136 | −0.217 | 28.200 |
| −0.165 | −0.400 | 28.200 |
| −0.225 | −0.437 | 28.200 |
| −0.750 | −0.793 | 28.200 |
| −1.190 | −1.169 | 28.200 |
| −1.217 | −1.181 | 28.200 |
| −1.224 | −1.180 | 28.200 |
| −1.174 | −1.068 | 28.200 |
| −0.755 | −0.565 | 28.200 |
| −0.484 | −0.323 | 28.200 |
| −0.426 | −0.278 | 28.200 |
| 0.133 | 0.061 | 28.200 |
| 0.741 | 0.302 | 28.200 |
| 1.092 | 0.398 | 28.200 |
| 1.163 | 0.414 | 28.200 |
| 1.336 | 0.439 | 28.200 |
| 1.059 | 0.296 | 28.200 |
| 0.996 | 0.265 | 28.200 |
| 0.439 | −0.037 | 28.200 |
| −0.105 | −0.364 | 28.200 |
| −0.404 | −0.550 | 28.200 |
| −0.463 | −0.589 | 28.200 |
| −0.970 | −0.969 | 28.200 |
| −1.211 | −1.181 | 28.200 |
| −1.231 | −1.164 | 28.200 |
| −1.230 | −1.158 | 28.200 |
| −0.999 | −0.835 | 28.200 |
| −0.540 | −0.369 | 28.200 |
| −0.247 | −0.154 | 28.200 |
| −0.186 | −0.114 | 28.200 |
| 0.399 | 0.180 | 28.200 |
| 1.022 | 0.380 | 28.200 |
| 1.321 | 0.447 | 28.200 |
| 1.324 | 0.447 | 28.200 |
| 1.335 | 0.427 | 28.200 |
| 1.123 | 0.327 | 28.200 |
| 0.808 | 0.168 | 28.200 |
| 0.746 | 0.135 | 28.200 |
| 0.196 | −0.181 | 28.200 |
| −0.345 | −0.512 | 28.200 |
| −0.637 | −0.709 | 28.200 |
| −0.694 | −0.751 | 28.200 |
| −1.178 | −1.159 | 28.200 |
| −1.230 | −1.170 | 28.200 |
| −1.223 | −1.141 | 28.200 |
| −1.215 | −1.127 | 28.200 |
| −0.806 | −0.617 | 28.200 |
| −0.308 | −0.194 | 28.200 |
| 0.003 | −0.005 | 28.200 |
| 0.068 | 0.029 | 28.200 |
| 0.672 | 0.280 | 28.200 |
| 1.306 | 0.444 | 28.200 |
| 1.332 | 0.444 | 28.200 |
| 1.334 | 0.441 | 28.200 |
| 0.871 | 0.201 | 28.200 |
| 0.561 | 0.033 | 28.200 |
| 0.500 | −0.002 | 28.200 |
| −0.045 | −0.327 | 28.200 |
| −0.579 | −0.669 | 28.200 |
| −0.861 | −0.880 | 28.200 |
| −0.916 | −0.924 | 28.200 |

TABLE 1-continued

| X | Y | Z |
|---|---|---|
| −1.206 | −1.179 | 28.200 |
| −1.226 | −1.146 | 28.200 |
| −1.089 | −0.950 | 28.200 |
| −1.044 | −0.892 | 28.200 |
| −0.596 | −0.416 | 28.200 |
| −0.061 | −0.040 | 28.200 |
| 0.265 | 0.123 | 28.200 |
| 0.331 | 0.152 | 28.200 |
| 0.951 | 0.362 | 28.200 |
| 1.330 | 0.445 | 28.200 |
| 1.337 | 0.433 | 28.200 |
| 1.337 | 0.430 | 28.200 |
| 1.187 | 0.357 | 28.200 |
| 0.623 | 0.067 | 28.200 |
| 0.317 | −0.109 | 28.200 |
| 0.257 | −0.144 | 28.200 |
| −0.285 | −0.474 | 28.200 |
| −0.806 | −0.836 | 28.200 |
| −1.076 | −1.063 | 28.200 |
| −1.127 | −1.110 | 28.200 |
| −1.228 | −1.176 | 28.200 |
| −1.132 | −1.008 | 28.200 |
| −0.905 | −0.724 | 28.200 |
| −0.856 | −0.670 | 28.200 |
| −0.367 | −0.235 | 28.200 |
| 0.198 | 0.093 | 28.200 |
| 0.534 | 0.232 | 28.200 |
| 0.603 | 0.256 | 28.200 |
| 1.234 | 0.429 | 28.200 |
| 1.337 | 0.436 | 28.200 |
| 1.332 | 0.422 | 28.200 |
| 1.329 | 0.421 | 28.200 |
| 0.933 | 0.233 | 28.200 |
| 0.378 | −0.073 | 28.200 |
| 0.075 | −0.253 | 28.200 |
| 0.015 | −0.290 | 28.200 |
| −0.521 | −0.629 | 28.200 |
| −1.023 | −1.016 | 28.200 |
| −1.195 | −1.172 | 28.200 |
| −1.200 | −1.176 | 28.200 |
| −1.228 | −1.152 | 28.200 |
| −0.952 | −0.779 | 28.200 |
| −0.703 | −0.514 | 28.200 |
| −0.650 | −0.464 | 28.200 |
| −0.124 | −0.077 | 28.200 |
| 0.466 | 0.207 | 28.200 |
| 0.811 | 0.323 | 28.200 |
| 0.881 | 0.343 | 28.200 |
| 1.327 | 0.446 | 28.200 |
| 1.334 | 0.424 | 28.200 |
| 1.333 | 0.437 | 29.150 |
| 0.879 | 0.219 | 29.150 |
| 0.563 | 0.047 | 29.150 |
| 0.500 | 0.012 | 29.150 |
| −0.056 | −0.320 | 29.150 |
| −0.601 | −0.670 | 29.150 |
| −0.890 | −0.884 | 29.150 |
| −0.946 | −0.928 | 29.150 |
| −1.246 | −1.183 | 29.150 |
| −1.268 | −1.150 | 29.150 |
| −1.134 | −0.944 | 29.150 |
| −1.090 | −0.884 | 29.150 |
| −0.635 | −0.392 | 29.150 |
| −0.083 | −0.012 | 29.150 |
| 0.252 | 0.151 | 29.150 |
| 0.321 | 0.180 | 29.150 |
| 0.959 | 0.388 | 29.150 |
| 1.348 | 0.469 | 29.150 |
| 1.355 | 0.455 | 29.150 |
| 1.355 | 0.452 | 29.150 |
| 1.202 | 0.378 | 29.150 |
| 1.071 | 0.316 | 29.150 |
| 0.625 | 0.083 | 29.150 |
| 0.314 | −0.097 | 29.150 |
| 0.252 | −0.134 | 29.150 |
| −0.301 | −0.472 | 29.150 |
| −0.833 | −0.840 | 29.150 |
| −1.111 | −1.067 | 29.150 |

TABLE 1-continued

| X | Y | Z |
|---|---|---|
| −1.165 | −1.115 | 29.150 |
| −1.270 | −1.181 | 29.150 |
| −1.177 | −1.005 | 29.150 |
| −0.950 | −0.709 | 29.150 |
| −0.900 | −0.653 | 29.150 |
| −0.400 | −0.208 | 29.150 |
| 0.184 | 0.121 | 29.150 |
| 0.530 | 0.260 | 29.150 |
| 0.601 | 0.284 | 29.150 |
| 1.250 | 0.454 | 29.150 |
| 1.355 | 0.459 | 29.150 |
| 1.349 | 0.444 | 29.150 |
| 1.347 | 0.443 | 29.150 |
| 0.943 | 0.252 | 29.150 |
| 0.376 | −0.060 | 29.150 |
| 0.067 | −0.245 | 29.150 |
| 0.006 | −0.283 | 29.150 |
| −0.541 | −0.629 | 29.150 |
| −1.057 | −1.020 | 29.150 |
| −1.235 | −1.177 | 29.150 |
| −1.241 | −1.180 | 29.150 |
| −1.270 | −1.156 | 29.150 |
| −0.998 | −0.766 | 29.150 |
| −0.745 | −0.492 | 29.150 |
| −0.690 | −0.441 | 29.150 |
| −0.148 | −0.049 | 29.150 |
| 0.460 | 0.234 | 29.150 |
| 0.814 | 0.350 | 29.150 |
| 0.886 | 0.370 | 29.150 |
| 1.345 | 0.470 | 29.150 |
| 1.352 | 0.447 | 29.150 |
| 1.267 | 0.407 | 29.150 |
| 0.688 | 0.117 | 29.150 |
| 0.128 | −0.208 | 29.150 |
| −0.178 | −0.396 | 29.150 |
| −0.240 | −0.433 | 29.150 |
| −0.776 | −0.796 | 29.150 |
| −1.230 | −1.174 | 29.150 |
| −1.259 | −1.186 | 29.150 |
| −1.265 | −1.185 | 29.150 |
| −1.218 | −1.067 | 29.150 |
| −0.798 | −0.545 | 29.150 |
| −0.520 | −0.297 | 29.150 |
| −0.460 | −0.252 | 29.150 |
| 0.116 | 0.090 | 29.150 |
| 0.743 | 0.329 | 29.150 |
| 1.104 | 0.423 | 29.150 |
| 1.177 | 0.439 | 29.150 |
| 1.354 | 0.462 | 29.150 |
| 1.007 | 0.284 | 29.150 |
| 0.438 | −0.024 | 29.150 |
| −0.117 | −0.358 | 29.150 |
| −0.422 | −0.549 | 29.150 |
| −0.482 | −0.589 | 29.150 |
| −1.002 | −0.974 | 29.150 |
| −1.252 | −1.185 | 29.150 |
| −1.273 | −1.168 | 29.150 |
| −1.272 | −1.162 | 29.150 |
| −1.044 | −0.825 | 29.150 |
| −0.578 | −0.344 | 29.150 |
| −0.276 | −0.126 | 29.150 |
| −0.212 | −0.086 | 29.150 |
| 0.390 | 0.208 | 29.150 |
| 1.031 | 0.406 | 29.150 |
| 1.338 | 0.470 | 29.150 |
| 1.342 | 0.470 | 29.150 |
| 1.353 | 0.449 | 29.150 |
| 1.136 | 0.347 | 29.150 |
| 0.815 | 0.186 | 29.150 |
| 0.752 | 0.152 | 29.150 |
| 0.190 | −0.171 | 29.150 |
| −0.361 | −0.510 | 29.150 |
| −0.659 | −0.711 | 29.150 |
| −0.718 | −0.753 | 29.150 |
| −1.218 | −1.164 | 29.150 |
| −1.272 | −1.175 | 29.150 |
| −1.266 | −1.144 | 29.150 |
| −1.258 | −1.130 | 29.150 |

TABLE 1-continued

| X | Y | Z |
|---|---|---|
| −0.850 | −0.598 | 29.150 |
| −0.338 | −0.166 | 29.150 |
| −0.017 | 0.023 | 29.150 |
| 0.049 | 0.057 | 29.150 |
| 0.672 | 0.307 | 29.150 |
| 1.323 | 0.468 | 29.150 |
| 1.350 | 0.467 | 29.150 |
| 1.352 | 0.464 | 29.150 |
| 0.889 | 0.240 | 30.100 |
| 0.567 | 0.065 | 30.100 |
| 0.503 | 0.028 | 30.100 |
| −0.064 | −0.311 | 30.100 |
| −0.617 | −0.671 | 30.100 |
| −0.913 | −0.888 | 30.100 |
| −0.971 | −0.933 | 30.100 |
| −1.283 | −1.187 | 30.100 |
| −1.307 | −1.151 | 30.100 |
| −1.177 | −0.936 | 30.100 |
| −1.133 | −0.873 | 30.100 |
| −0.672 | −0.365 | 30.100 |
| −0.103 | 0.018 | 30.100 |
| 0.242 | 0.181 | 30.100 |
| 0.313 | 0.210 | 30.100 |
| 0.968 | 0.417 | 30.100 |
| 1.376 | 0.481 | 30.100 |
| 1.375 | 0.478 | 30.100 |
| 1.218 | 0.401 | 30.100 |
| 0.631 | 0.101 | 30.100 |
| 0.313 | −0.083 | 30.100 |
| 0.250 | −0.120 | 30.100 |
| −0.312 | −0.467 | 30.100 |
| −0.855 | −0.843 | 30.100 |
| −1.142 | −1.072 | 30.100 |
| −1.198 | −1.119 | 30.100 |
| −1.308 | −1.183 | 30.100 |
| −1.219 | −1.000 | 30.100 |
| −0.993 | −0.692 | 30.100 |
| −0.943 | −0.634 | 30.100 |
| −0.430 | −0.179 | 30.100 |
| 0.172 | 0.151 | 30.100 |
| 0.528 | 0.289 | 30.100 |
| 0.600 | 0.313 | 30.100 |
| 1.267 | 0.481 | 30.100 |
| 1.369 | 0.470 | 30.100 |
| 1.352 | 0.462 | 30.100 |
| 1.366 | 0.468 | 30.100 |
| 1.086 | 0.339 | 30.100 |
| 0.954 | 0.273 | 30.100 |
| 0.376 | −0.045 | 30.100 |
| 0.061 | −0.235 | 30.100 |
| −0.001 | −0.273 | 30.100 |
| −0.557 | −0.629 | 30.100 |
| −1.086 | −1.025 | 30.100 |
| −1.271 | −1.181 | 30.100 |
| −1.277 | −1.184 | 30.100 |
| −1.309 | −1.158 | 30.100 |
| −1.042 | −0.751 | 30.100 |
| −0.785 | −0.468 | 30.100 |
| −0.729 | −0.416 | 30.100 |
| −0.170 | −0.019 | 30.100 |
| 0.456 | 0.264 | 30.100 |
| 0.820 | 0.378 | 30.100 |
| 0.894 | 0.398 | 30.100 |
| 1.365 | 0.497 | 30.100 |
| 1.368 | 0.495 | 30.100 |
| 1.375 | 0.485 | 30.100 |
| 1.372 | 0.472 | 30.100 |
| 1.285 | 0.432 | 30.100 |
| 0.695 | 0.136 | 30.100 |
| 0.124 | −0.196 | 30.100 |
| −0.188 | −0.389 | 30.100 |
| −0.250 | −0.428 | 30.100 |
| −0.796 | −0.799 | 30.100 |
| −1.266 | −1.177 | 30.100 |
| −1.296 | −1.189 | 30.100 |
| −1.303 | −1.188 | 30.100 |
| −1.259 | −1.065 | 30.100 |
| −0.839 | −0.522 | 30.100 |

TABLE 1-continued

| X | Y | Z |
|---|---|---|
| −0.554 | −0.269 | 30.100 |
| −0.492 | −0.223 | 30.100 |
| 0.102 | 0.119 | 30.100 |
| 0.747 | 0.358 | 30.100 |
| 1.117 | 0.451 | 30.100 |
| 1.192 | 0.466 | 30.100 |
| 1.374 | 0.488 | 30.100 |
| 1.020 | 0.306 | 30.100 |
| 0.439 | −0.008 | 30.100 |
| −0.126 | −0.350 | 30.100 |
| −0.435 | −0.547 | 30.100 |
| −0.496 | −0.588 | 30.100 |
| −1.029 | −0.979 | 30.100 |
| −1.290 | −1.189 | 30.100 |
| −1.311 | −1.171 | 30.100 |
| −1.311 | −1.164 | 30.100 |
| −1.088 | −0.811 | 30.100 |
| −0.614 | −0.316 | 30.100 |
| −0.302 | −0.096 | 30.100 |
| −0.236 | −0.057 | 30.100 |
| 0.384 | 0.237 | 30.100 |
| 1.042 | 0.434 | 30.100 |
| 1.358 | 0.497 | 30.100 |
| 1.361 | 0.497 | 30.100 |
| 1.374 | 0.475 | 30.100 |
| 1.152 | 0.370 | 30.100 |
| 0.824 | 0.206 | 30.100 |
| 0.759 | 0.171 | 30.100 |
| 0.187 | −0.158 | 30.100 |
| −0.374 | −0.507 | 30.100 |
| −0.677 | −0.713 | 30.100 |
| −0.737 | −0.756 | 30.100 |
| −1.254 | −1.167 | 30.100 |
| −1.311 | −1.177 | 30.100 |
| −1.305 | −1.145 | 30.100 |
| −1.298 | −1.130 | 30.100 |
| −0.892 | −0.577 | 30.100 |
| −0.366 | −0.137 | 30.100 |
| −0.035 | 0.053 | 30.100 |
| 0.033 | 0.087 | 30.100 |
| 0.673 | 0.336 | 30.100 |
| 1.342 | 0.495 | 30.100 |
| 1.370 | 0.493 | 30.100 |
| 1.373 | 0.491 | 30.100 |
| 1.373 | 0.488 | 31.050 |
| 1.101 | 0.363 | 31.050 |
| 0.835 | 0.227 | 31.050 |
| 0.572 | 0.084 | 31.050 |
| 0.313 | −0.067 | 31.050 |
| 0.058 | −0.222 | 31.050 |
| −0.196 | −0.380 | 31.050 |
| −0.447 | −0.544 | 31.050 |
| −0.692 | −0.715 | 31.050 |
| −0.933 | −0.892 | 31.050 |
| −1.170 | −1.075 | 31.050 |
| −1.305 | −1.182 | 31.050 |
| −1.331 | −1.191 | 31.050 |
| −1.347 | −1.171 | 31.050 |
| −1.341 | −1.144 | 31.050 |
| −1.219 | −0.925 | 31.050 |
| −1.036 | −0.672 | 31.050 |
| −0.824 | −0.442 | 31.050 |
| −0.586 | −0.240 | 31.050 |
| −0.326 | −0.066 | 31.050 |
| −0.051 | 0.082 | 31.050 |
| 0.234 | 0.210 | 31.050 |
| 0.528 | 0.318 | 31.050 |
| 0.827 | 0.407 | 31.050 |
| 1.132 | 0.479 | 31.050 |
| 1.379 | 0.526 | 31.050 |
| 1.392 | 0.522 | 31.050 |
| 1.397 | 0.509 | 31.050 |
| 1.391 | 0.496 | 31.050 |
| 1.388 | 0.494 | 31.050 |
| 1.305 | 0.458 | 31.050 |
| 1.034 | 0.330 | 31.050 |
| 0.769 | 0.192 | 31.050 |
| 0.507 | 0.047 | 31.050 |

TABLE 1-continued

| X | Y | Z |
|---|---|---|
| 0.249 | −0.105 | 31.050 |
| −0.006 | −0.261 | 31.050 |
| −0.259 | −0.421 | 31.050 |
| −0.508 | −0.586 | 31.050 |
| −0.753 | −0.759 | 31.050 |
| −0.993 | −0.937 | 31.050 |
| −1.228 | −1.122 | 31.050 |
| −1.311 | −1.186 | 31.050 |
| −1.338 | −1.189 | 31.050 |
| −1.347 | −1.164 | 31.050 |
| −1.335 | −1.129 | 31.050 |
| −1.176 | −0.860 | 31.050 |
| −0.986 | −0.612 | 31.050 |
| −0.767 | −0.389 | 31.050 |
| −0.523 | −0.194 | 31.050 |
| −0.258 | −0.027 | 31.050 |
| 0.019 | 0.116 | 31.050 |
| 0.307 | 0.239 | 31.050 |
| 0.602 | 0.342 | 31.050 |
| 0.903 | 0.427 | 31.050 |
| 1.208 | 0.495 | 31.050 |
| 1.382 | 0.526 | 31.050 |
| 1.394 | 0.519 | 31.050 |
| 1.397 | 0.505 | 31.050 |
| 1.237 | 0.427 | 31.050 |
| 0.967 | 0.296 | 31.050 |
| 0.703 | 0.157 | 31.050 |
| 0.442 | 0.009 | 31.050 |
| 0.185 | −0.144 | 31.050 |
| −0.069 | −0.301 | 31.050 |
| −0.322 | −0.461 | 31.050 |
| −0.570 | −0.629 | 31.050 |
| −0.813 | −0.803 | 31.050 |
| −1.052 | −0.983 | 31.050 |
| −1.286 | −1.169 | 31.050 |
| −1.318 | −1.188 | 31.050 |
| −1.343 | −1.185 | 31.050 |
| −1.346 | −1.158 | 31.050 |
| −1.298 | −1.060 | 31.050 |
| −1.132 | −0.796 | 31.050 |
| −0.934 | −0.554 | 31.050 |
| −0.708 | −0.337 | 31.050 |
| −0.458 | −0.149 | 31.050 |
| −0.190 | 0.011 | 31.050 |
| 0.091 | 0.149 | 31.050 |
| 0.380 | 0.267 | 31.050 |
| 0.677 | 0.365 | 31.050 |
| 0.979 | 0.445 | 31.050 |
| 1.285 | 0.510 | 31.050 |
| 1.386 | 0.525 | 31.050 |
| 1.396 | 0.516 | 31.050 |
| 1.395 | 0.502 | 31.050 |
| 1.169 | 0.395 | 31.050 |
| 0.901 | 0.262 | 31.050 |
| 0.637 | 0.120 | 31.050 |
| 0.378 | −0.029 | 31.050 |
| 0.121 | −0.183 | 31.050 |
| −0.133 | −0.340 | 31.050 |
| −0.384 | −0.502 | 31.050 |
| −0.631 | −0.672 | 31.050 |
| −0.873 | −0.847 | 31.050 |
| −1.111 | −1.029 | 31.050 |
| −1.299 | −1.179 | 31.050 |
| −1.324 | −1.190 | 31.050 |
| −1.346 | −1.178 | 31.050 |
| −1.344 | −1.151 | 31.050 |
| −1.260 | −0.992 | 31.050 |
| −1.085 | −0.733 | 31.050 |
| −0.880 | −0.497 | 31.050 |
| −0.648 | −0.288 | 31.050 |
| −0.393 | −0.107 | 31.050 |
| −0.121 | 0.047 | 31.050 |
| 0.162 | 0.180 | 31.050 |
| 0.454 | 0.293 | 31.050 |
| 0.752 | 0.387 | 31.050 |
| 1.055 | 0.463 | 31.050 |
| 1.362 | 0.523 | 31.050 |
| 1.389 | 0.524 | 31.050 |

TABLE 1-continued

| X | Y | Z |
|---|---|---|
| 1.397 | 0.512 | 31.050 |
| 1.393 | 0.499 | 31.050 |
| 1.394 | 0.514 | 32.000 |
| 1.117 | 0.387 | 32.000 |
| 0.913 | 0.285 | 32.000 |
| 0.578 | 0.104 | 32.000 |
| 0.512 | 0.066 | 32.000 |
| −0.075 | −0.288 | 32.000 |
| −0.644 | −0.671 | 32.000 |
| −0.951 | −0.896 | 32.000 |
| −1.012 | −0.941 | 32.000 |
| −1.350 | −1.188 | 32.000 |
| −1.382 | −1.170 | 32.000 |
| −1.379 | −1.148 | 32.000 |
| −1.261 | −0.913 | 32.000 |
| −1.219 | −0.845 | 32.000 |
| −0.862 | −0.415 | 32.000 |
| −0.743 | −0.309 | 32.000 |
| −0.137 | 0.076 | 32.000 |
| 0.228 | 0.238 | 32.000 |
| 0.302 | 0.267 | 32.000 |
| 0.991 | 0.473 | 32.000 |
| 1.410 | 0.552 | 32.000 |
| 1.419 | 0.536 | 32.000 |
| 1.418 | 0.532 | 32.000 |
| 1.255 | 0.452 | 32.000 |
| 0.644 | 0.141 | 32.000 |
| 0.314 | −0.049 | 32.000 |
| 0.249 | −0.088 | 32.000 |
| −0.331 | −0.453 | 32.000 |
| −0.890 | −0.851 | 32.000 |
| −1.195 | −1.078 | 32.000 |
| −1.257 | −1.123 | 32.000 |
| −1.377 | −1.184 | 32.000 |
| −1.300 | −0.982 | 32.000 |
| −1.079 | −0.650 | 32.000 |
| −1.028 | −0.589 | 32.000 |
| −0.485 | −0.120 | 32.000 |
| 0.153 | 0.208 | 32.000 |
| 0.529 | 0.346 | 32.000 |
| 0.605 | 0.370 | 32.000 |
| 1.304 | 0.537 | 32.000 |
| 1.419 | 0.539 | 32.000 |
| 1.412 | 0.523 | 32.000 |
| 1.409 | 0.521 | 32.000 |
| 0.981 | 0.319 | 32.000 |
| 0.380 | −0.010 | 32.000 |
| 0.054 | −0.207 | 32.000 |
| −0.011 | −0.248 | 32.000 |
| −0.582 | −0.627 | 32.000 |
| −1.134 | −1.032 | 32.000 |
| −1.337 | −1.182 | 32.000 |
| −1.343 | −1.185 | 32.000 |
| −1.380 | −1.156 | 32.000 |
| −1.128 | −0.713 | 32.000 |
| −0.803 | −0.361 | 32.000 |
| −0.209 | 0.040 | 32.000 |
| 0.453 | 0.321 | 32.000 |
| 0.835 | 0.435 | 32.000 |
| 0.913 | 0.455 | 32.000 |
| 1.407 | 0.553 | 32.000 |
| 1.415 | 0.525 | 32.000 |
| 1.324 | 0.483 | 32.000 |
| 0.711 | 0.177 | 32.000 |
| 0.119 | −0.167 | 32.000 |
| −0.204 | −0.369 | 32.000 |
| −0.268 | −0.411 | 32.000 |
| −0.829 | −0.805 | 32.000 |
| −1.331 | −1.178 | 32.000 |
| −1.365 | −1.190 | 32.000 |
| −1.371 | −1.188 | 32.000 |
| −1.336 | −1.053 | 32.000 |
| −0.919 | −0.471 | 32.000 |
| −0.617 | −0.211 | 32.000 |
| −0.552 | −0.164 | 32.000 |
| 0.080 | 0.177 | 32.000 |
| 0.758 | 0.414 | 32.000 |
| 1.147 | 0.507 | 32.000 |

TABLE 1-continued

| X | Y | Z |
|---|---|---|
| 1.225 | 0.523 | 32.000 |
| 1.418 | 0.543 | 32.000 |
| 1.049 | 0.353 | 32.000 |
| 0.446 | 0.028 | 32.000 |
| −0.140 | −0.328 | 32.000 |
| −0.457 | −0.539 | 32.000 |
| −0.520 | −0.583 | 32.000 |
| −1.073 | −0.987 | 32.000 |
| −1.357 | −1.190 | 32.000 |
| −1.382 | −1.163 | 32.000 |
| −1.175 | −0.778 | 32.000 |
| −0.681 | −0.259 | 32.000 |
| −0.349 | −0.037 | 32.000 |
| −0.279 | 0.002 | 32.000 |
| 0.377 | 0.295 | 32.000 |
| 1.069 | 0.491 | 32.000 |
| 1.399 | 0.554 | 32.000 |
| 1.403 | 0.554 | 32.000 |
| 1.417 | 0.528 | 32.000 |
| 1.186 | 0.420 | 32.000 |
| 0.845 | 0.249 | 32.000 |
| 0.778 | 0.214 | 32.000 |
| 0.184 | −0.128 | 32.000 |
| −0.395 | −0.496 | 32.000 |
| −0.706 | −0.716 | 32.000 |
| −0.767 | −0.760 | 32.000 |
| −1.318 | −1.169 | 32.000 |
| −1.380 | −1.177 | 32.000 |
| −1.376 | −1.142 | 32.000 |
| −1.370 | −1.126 | 32.000 |
| −0.975 | −0.529 | 32.000 |
| −0.418 | −0.078 | 32.000 |
| −0.066 | 0.111 | 32.000 |
| 0.007 | 0.145 | 32.000 |
| 0.681 | 0.393 | 32.000 |
| 1.383 | 0.551 | 32.000 |
| 1.413 | 0.549 | 32.000 |
| 1.416 | 0.546 | 32.000 |
| 1.414 | 0.538 | 32.950 |
| 1.132 | 0.409 | 32.950 |
| 0.924 | 0.306 | 32.950 |
| 0.583 | 0.122 | 32.950 |
| 0.516 | 0.084 | 32.950 |
| −0.082 | −0.274 | 32.950 |
| −0.656 | −0.669 | 32.950 |
| −0.967 | −0.899 | 32.950 |
| −1.030 | −0.945 | 32.950 |
| −1.382 | −1.185 | 32.950 |
| −1.415 | −1.166 | 32.950 |
| −1.413 | −1.143 | 32.950 |
| −1.303 | −0.897 | 32.950 |
| −1.262 | −0.827 | 32.950 |
| −0.900 | −0.387 | 32.950 |
| −0.777 | −0.281 | 32.950 |
| −0.154 | 0.104 | 32.950 |
| 0.221 | 0.265 | 32.950 |
| 0.297 | 0.293 | 32.950 |
| 1.002 | 0.499 | 32.950 |
| 1.431 | 0.577 | 32.950 |
| 1.440 | 0.560 | 32.950 |
| 1.439 | 0.556 | 32.950 |
| 1.273 | 0.475 | 32.950 |
| 0.651 | 0.160 | 32.950 |
| 0.315 | −0.032 | 32.950 |
| 0.248 | −0.072 | 32.950 |
| −0.341 | −0.443 | 32.950 |
| −0.905 | −0.854 | 32.950 |
| −1.219 | −1.079 | 32.950 |
| −1.283 | −1.123 | 32.950 |
| −1.410 | −1.180 | 32.950 |
| −1.340 | −0.970 | 32.950 |
| −1.122 | −0.626 | 32.950 |
| −1.070 | −0.563 | 32.950 |
| −0.512 | −0.091 | 32.950 |
| 0.145 | 0.235 | 32.950 |
| 0.529 | 0.372 | 32.950 |
| 0.607 | 0.396 | 32.950 |
| 1.322 | 0.563 | 32.950 |

TABLE 1-continued

| X | Y | Z |
|---|---|---|
| 1.439 | 0.564 | 32.950 |
| 1.433 | 0.546 | 32.950 |
| 1.429 | 0.544 | 32.950 |
| 0.993 | 0.341 | 32.950 |
| 0.382 | 0.007 | 32.950 |
| 0.050 | −0.193 | 32.950 |
| −0.016 | −0.233 | 32.950 |
| −0.593 | −0.623 | 32.950 |
| −1.156 | −1.035 | 32.950 |
| −1.368 | −1.179 | 32.950 |
| −1.375 | −1.182 | 32.950 |
| −1.414 | −1.151 | 32.950 |
| −1.172 | −0.691 | 32.950 |
| −0.840 | −0.333 | 32.950 |
| −0.227 | 0.068 | 32.950 |
| 0.451 | 0.347 | 32.950 |
| 0.843 | 0.461 | 32.950 |
| 0.922 | 0.480 | 32.950 |
| 1.427 | 0.579 | 32.950 |
| 1.435 | 0.549 | 32.950 |
| 1.343 | 0.506 | 32.950 |
| 0.719 | 0.197 | 32.950 |
| 0.116 | −0.152 | 32.950 |
| −0.213 | −0.357 | 32.950 |
| −0.277 | −0.400 | 32.950 |
| −0.842 | −0.808 | 32.950 |
| −1.361 | −1.175 | 32.950 |
| −1.397 | −1.187 | 32.950 |
| −1.404 | −1.184 | 32.950 |
| −1.374 | −1.044 | 32.950 |
| −0.959 | −0.444 | 32.950 |
| −0.647 | −0.182 | 32.950 |
| −0.580 | −0.136 | 32.950 |
| 0.069 | 0.204 | 32.950 |
| 0.764 | 0.440 | 32.950 |
| 1.161 | 0.533 | 32.950 |
| 1.241 | 0.548 | 32.950 |
| 1.438 | 0.568 | 32.950 |
| 1.063 | 0.375 | 32.950 |
| 0.448 | 0.046 | 32.950 |
| −0.147 | −0.315 | 32.950 |
| −0.468 | −0.532 | 32.950 |
| −0.531 | −0.578 | 32.950 |
| −1.093 | −0.990 | 32.950 |
| −1.389 | −1.187 | 32.950 |
| −1.415 | −1.158 | 32.950 |
| −1.219 | −0.758 | 32.950 |
| −0.713 | −0.230 | 32.950 |
| −0.371 | −0.008 | 32.950 |
| −0.300 | 0.031 | 32.950 |
| 0.374 | 0.321 | 32.950 |
| 1.081 | 0.516 | 32.950 |
| 1.419 | 0.579 | 32.950 |
| 1.423 | 0.580 | 32.950 |
| 1.438 | 0.553 | 32.950 |
| 1.202 | 0.442 | 32.950 |
| 0.856 | 0.270 | 32.950 |
| 0.787 | 0.234 | 32.950 |
| 0.182 | −0.112 | 32.950 |
| −0.405 | −0.488 | 32.950 |
| −0.718 | −0.715 | 32.950 |
| −0.780 | −0.762 | 32.950 |
| −1.347 | −1.166 | 32.950 |
| −1.413 | −1.173 | 32.950 |
| −1.411 | −1.136 | 32.950 |
| −1.405 | −1.120 | 32.950 |
| −1.016 | −0.502 | 32.950 |
| −0.442 | −0.049 | 32.950 |
| −0.080 | 0.139 | 32.950 |
| −0.006 | 0.172 | 32.950 |
| 0.685 | 0.418 | 32.950 |
| 1.402 | 0.577 | 32.950 |
| 1.434 | 0.575 | 32.950 |
| 1.436 | 0.572 | 32.950 |
| 1.432 | 0.557 | 33.900 |
| 1.145 | 0.427 | 33.900 |
| 0.934 | 0.324 | 33.900 |
| 0.586 | 0.140 | 33.900 |

TABLE 1-continued

| X | Y | Z |
|---|---|---|
| 0.518 | 0.102 | 33.900 |
| −0.091 | −0.259 | 33.900 |
| −0.670 | −0.665 | 33.900 |
| −0.983 | −0.902 | 33.900 |
| −1.047 | −0.947 | 33.900 |
| −1.413 | −1.179 | 33.900 |
| −1.448 | −1.158 | 33.900 |
| −1.446 | −1.135 | 33.900 |
| −1.346 | −0.879 | 33.900 |
| −1.306 | −0.806 | 33.900 |
| −0.937 | −0.360 | 33.900 |
| −0.810 | −0.254 | 33.900 |
| −0.170 | 0.129 | 33.900 |
| 0.214 | 0.288 | 33.900 |
| 0.292 | 0.316 | 33.900 |
| 1.011 | 0.520 | 33.900 |
| 1.449 | 0.599 | 33.900 |
| 1.459 | 0.581 | 33.900 |
| 1.458 | 0.576 | 33.900 |
| 1.288 | 0.494 | 33.900 |
| 0.655 | 0.178 | 33.900 |
| 0.313 | −0.015 | 33.900 |
| 0.245 | −0.055 | 33.900 |
| −0.354 | −0.431 | 33.900 |
| −0.920 | −0.855 | 33.900 |
| −1.243 | −1.079 | 33.900 |
| −1.309 | −1.121 | 33.900 |
| −1.442 | −1.173 | 33.900 |
| −1.382 | −0.955 | 33.900 |
| −1.166 | −0.601 | 33.900 |
| −1.112 | −0.537 | 33.900 |
| −0.537 | −0.065 | 33.900 |
| 0.136 | 0.259 | 33.900 |
| 0.529 | 0.394 | 33.900 |
| 0.609 | 0.417 | 33.900 |
| 1.337 | 0.584 | 33.900 |
| 1.458 | 0.585 | 33.900 |
| 1.451 | 0.566 | 33.900 |
| 1.447 | 0.564 | 33.900 |
| 1.004 | 0.359 | 33.900 |
| 0.381 | 0.024 | 33.900 |
| 0.043 | −0.176 | 33.900 |
| −0.024 | −0.217 | 33.900 |
| −0.607 | −0.617 | 33.900 |
| −1.177 | −1.036 | 33.900 |
| −1.398 | −1.173 | 33.900 |
| −1.405 | −1.176 | 33.900 |
| −1.448 | −1.143 | 33.900 |
| −1.216 | −0.667 | 33.900 |
| −0.874 | −0.306 | 33.900 |
| −0.245 | 0.094 | 33.900 |
| 0.450 | 0.369 | 33.900 |
| 0.849 | 0.482 | 33.900 |
| 0.930 | 0.501 | 33.900 |
| 1.445 | 0.600 | 33.900 |
| 1.454 | 0.569 | 33.900 |
| 1.360 | 0.525 | 33.900 |
| 0.724 | 0.215 | 33.900 |
| 0.110 | −0.135 | 33.900 |
| −0.223 | −0.343 | 33.900 |
| −0.289 | −0.387 | 33.900 |
| −0.857 | −0.808 | 33.900 |
| −1.391 | −1.169 | 33.900 |
| −1.429 | −1.180 | 33.900 |
| −1.436 | −1.178 | 33.900 |
| −1.413 | −1.032 | 33.900 |
| −0.998 | −0.417 | 33.900 |
| −0.676 | −0.155 | 33.900 |
| −0.607 | −0.109 | 33.900 |
| 0.059 | 0.228 | 33.900 |
| 0.769 | 0.461 | 33.900 |
| 1.174 | 0.554 | 33.900 |
| 1.255 | 0.570 | 33.900 |
| 1.457 | 0.589 | 33.900 |
| 1.075 | 0.393 | 33.900 |
| 0.449 | 0.063 | 33.900 |
| −0.157 | −0.301 | 33.900 |
| −0.482 | −0.523 | 33.900 |

TABLE 1-continued

| X | Y | Z |
|---|---|---|
| −0.545 | −0.569 | 33.900 |
| −1.112 | −0.992 | 33.900 |
| −1.421 | −1.180 | 33.900 |
| −1.448 | −1.151 | 33.900 |
| −1.263 | −0.736 | 33.900 |
| −0.743 | −0.204 | 33.900 |
| −0.393 | 0.019 | 33.900 |
| −0.319 | 0.057 | 33.900 |
| 0.371 | 0.343 | 33.900 |
| 1.092 | 0.537 | 33.900 |
| 1.436 | 0.601 | 33.900 |
| 1.441 | 0.601 | 33.900 |
| 1.456 | 0.572 | 33.900 |
| 1.217 | 0.461 | 33.900 |
| 0.864 | 0.288 | 33.900 |
| 0.794 | 0.252 | 33.900 |
| 0.177 | −0.095 | 33.900 |
| −0.418 | −0.477 | 33.900 |
| −0.732 | −0.713 | 33.900 |
| −0.794 | −0.760 | 33.900 |
| −1.377 | −1.161 | 33.900 |
| −1.446 | −1.166 | 33.900 |
| −1.444 | −1.127 | 33.900 |
| −1.439 | −1.110 | 33.900 |
| −1.056 | −0.476 | 33.900 |
| −0.465 | −0.022 | 33.900 |
| −0.094 | 0.164 | 33.900 |
| −0.018 | 0.196 | 33.900 |
| 0.689 | 0.440 | 33.900 |
| 1.419 | 0.598 | 33.900 |
| 1.452 | 0.596 | 33.900 |
| 1.455 | 0.593 | 33.900 |
| 1.448 | 0.569 | 34.850 |
| 1.157 | 0.439 | 34.850 |
| 0.942 | 0.335 | 34.850 |
| 0.589 | 0.152 | 34.850 |
| 0.519 | 0.114 | 34.850 |
| −0.101 | −0.245 | 34.850 |
| −0.684 | −0.660 | 34.850 |
| −0.999 | −0.904 | 34.850 |
| −1.063 | −0.950 | 34.850 |
| −1.444 | −1.168 | 34.850 |
| −1.481 | −1.146 | 34.850 |
| −1.480 | −1.122 | 34.850 |
| −1.391 | −0.857 | 34.850 |
| −1.353 | −0.782 | 34.850 |
| −0.974 | −0.332 | 34.850 |
| −0.843 | −0.226 | 34.850 |
| −0.187 | 0.155 | 34.850 |
| 0.206 | 0.310 | 34.850 |
| 0.286 | 0.337 | 34.850 |
| 1.019 | 0.536 | 34.850 |
| 1.466 | 0.613 | 34.850 |
| 1.476 | 0.594 | 34.850 |
| 1.475 | 0.589 | 34.850 |
| 1.302 | 0.505 | 34.850 |
| 0.659 | 0.190 | 34.850 |
| 0.311 | −0.003 | 34.850 |
| 0.242 | −0.042 | 34.850 |
| −0.366 | −0.420 | 34.850 |
| −0.935 | −0.857 | 34.850 |
| −1.265 | −1.077 | 34.850 |
| −1.335 | −1.116 | 34.850 |
| −1.474 | −1.161 | 34.850 |
| −1.425 | −0.935 | 34.850 |
| −1.211 | −0.573 | 34.850 |
| −1.156 | −0.509 | 34.850 |
| −0.563 | −0.037 | 34.850 |
| 0.126 | 0.281 | 34.850 |
| 0.528 | 0.413 | 34.850 |
| 0.609 | 0.436 | 34.850 |
| 1.351 | 0.599 | 34.850 |
| 1.476 | 0.598 | 34.850 |
| 1.468 | 0.578 | 34.850 |
| 1.464 | 0.576 | 34.850 |
| 1.014 | 0.370 | 34.850 |
| 0.380 | 0.037 | 34.850 |
| 0.036 | −0.163 | 34.850 |

TABLE 1-continued

| X | Y | Z |
|---|---|---|
| −0.033 | −0.204 | 34.850 |
| −0.622 | −0.610 | 34.850 |
| −1.197 | −1.037 | 34.850 |
| −1.428 | −1.163 | 34.850 |
| −1.436 | −1.166 | 34.850 |
| −1.481 | −1.130 | 34.850 |
| −1.262 | −0.640 | 34.850 |
| −0.909 | −0.278 | 34.850 |
| −0.264 | 0.121 | 34.850 |
| 0.447 | 0.389 | 34.850 |
| 0.854 | 0.499 | 34.850 |
| 0.937 | 0.518 | 34.850 |
| 1.461 | 0.615 | 34.850 |
| 1.471 | 0.581 | 34.850 |
| 1.375 | 0.537 | 34.850 |
| 0.730 | 0.227 | 34.850 |
| 0.104 | −0.122 | 34.850 |
| −0.235 | −0.331 | 34.850 |
| −0.301 | −0.375 | 34.850 |
| −0.871 | −0.808 | 34.850 |
| −1.421 | −1.159 | 34.850 |
| −1.460 | −1.169 | 34.850 |
| −1.468 | −1.167 | 34.850 |
| −1.452 | −1.015 | 34.850 |
| −1.037 | −0.388 | 34.850 |
| −0.705 | −0.128 | 34.850 |
| −0.635 | −0.081 | 34.850 |
| 0.047 | 0.251 | 34.850 |
| 0.772 | 0.479 | 34.850 |
| 1.185 | 0.570 | 34.850 |
| 1.268 | 0.585 | 34.850 |
| 1.475 | 0.603 | 34.850 |
| 1.085 | 0.405 | 34.850 |
| 0.449 | 0.076 | 34.850 |
| −0.168 | −0.288 | 34.850 |
| −0.495 | −0.514 | 34.850 |
| −0.559 | −0.561 | 34.850 |
| −1.130 | −0.994 | 34.850 |
| −1.452 | −1.170 | 34.850 |
| −1.481 | −1.138 | 34.850 |
| −1.310 | −0.710 | 34.850 |
| −0.775 | −0.176 | 34.850 |
| −0.416 | 0.046 | 34.850 |
| −0.340 | 0.084 | 34.850 |
| 0.366 | 0.363 | 34.850 |
| 1.102 | 0.553 | 34.850 |
| 1.452 | 0.616 | 34.850 |
| 1.457 | 0.616 | 34.850 |
| 1.474 | 0.585 | 34.850 |
| 1.230 | 0.472 | 34.850 |
| 0.871 | 0.300 | 34.850 |
| 0.800 | 0.263 | 34.850 |
| 0.173 | −0.082 | 34.850 |
| −0.431 | −0.467 | 34.850 |
| −0.747 | −0.709 | 34.850 |
| −0.809 | −0.759 | 34.850 |
| −1.406 | −1.152 | 34.850 |
| −1.479 | −1.154 | 34.850 |
| −1.478 | −1.114 | 34.850 |
| −1.474 | −1.096 | 34.850 |
| −1.098 | −0.447 | 34.850 |
| −0.490 | 0.005 | 34.850 |
| −0.109 | 0.188 | 34.850 |
| −0.031 | 0.221 | 34.850 |
| 0.690 | 0.458 | 34.850 |
| 1.435 | 0.613 | 34.850 |
| 1.469 | 0.610 | 34.850 |
| 1.472 | 0.607 | 34.850 |
| 1.464 | 0.578 | 35.800 |
| 1.170 | 0.446 | 35.800 |
| 0.953 | 0.342 | 35.800 |
| 0.594 | 0.159 | 35.800 |
| 0.523 | 0.121 | 35.800 |
| −0.107 | −0.237 | 35.800 |
| −0.697 | −0.657 | 35.800 |
| −1.010 | −0.909 | 35.800 |
| −1.076 | −0.955 | 35.800 |
| −1.474 | −1.152 | 35.800 |

TABLE 1-continued

| X | Y | Z |
|---|---|---|
| −1.513 | −1.129 | 35.800 |
| −1.513 | −1.103 | 35.800 |
| −1.441 | −0.829 | 35.800 |
| −1.404 | −0.751 | 35.800 |
| −1.014 | −0.299 | 35.800 |
| −0.879 | −0.193 | 35.800 |
| −0.207 | 0.185 | 35.800 |
| 0.197 | 0.333 | 35.800 |
| 0.278 | 0.359 | 35.800 |
| 1.027 | 0.550 | 35.800 |
| 1.483 | 0.625 | 35.800 |
| 1.494 | 0.604 | 35.800 |
| 1.493 | 0.599 | 35.800 |
| 1.317 | 0.513 | 35.800 |
| 0.665 | 0.196 | 35.800 |
| 0.311 | 0.005 | 35.800 |
| 0.241 | −0.034 | 35.800 |
| −0.376 | −0.414 | 35.800 |
| −0.946 | −0.861 | 35.800 |
| −1.286 | −1.075 | 35.800 |
| −1.359 | −1.109 | 35.800 |
| −1.506 | −1.144 | 35.800 |
| −1.471 | −0.909 | 35.800 |
| −1.260 | −0.538 | 35.800 |
| −1.203 | −0.474 | 35.800 |
| −0.592 | −0.005 | 35.800 |
| 0.115 | 0.305 | 35.800 |
| 0.526 | 0.431 | 35.800 |
| 0.609 | 0.454 | 35.800 |
| 1.365 | 0.612 | 35.800 |
| 1.493 | 0.609 | 35.800 |
| 1.484 | 0.587 | 35.800 |
| 1.480 | 0.585 | 35.800 |
| 1.025 | 0.377 | 35.800 |
| 0.382 | 0.044 | 35.800 |
| 0.031 | −0.154 | 35.800 |
| −0.038 | −0.195 | 35.800 |
| −0.634 | −0.607 | 35.800 |
| −1.214 | −1.038 | 35.800 |
| −1.458 | −1.148 | 35.800 |
| −1.466 | −1.150 | 35.800 |
| −1.514 | −1.112 | 35.800 |
| −1.313 | −0.606 | 35.800 |
| −0.947 | −0.245 | 35.800 |
| −0.286 | 0.151 | 35.800 |
| 0.443 | 0.408 | 35.800 |
| 0.859 | 0.514 | 35.800 |
| 0.943 | 0.532 | 35.800 |
| 1.478 | 0.627 | 35.800 |
| 1.488 | 0.591 | 35.800 |
| 1.390 | 0.546 | 35.800 |
| 0.737 | 0.233 | 35.800 |
| 0.101 | −0.114 | 35.800 |
| −0.243 | −0.323 | 35.800 |
| −0.310 | −0.368 | 35.800 |
| −0.883 | −0.811 | 35.800 |
| −1.450 | −1.145 | 35.800 |
| −1.491 | −1.153 | 35.800 |
| −1.499 | −1.150 | 35.800 |
| −1.494 | −0.992 | 35.800 |
| −1.080 | −0.355 | 35.800 |
| −0.738 | −0.095 | 35.800 |
| −0.665 | −0.049 | 35.800 |
| 0.034 | 0.277 | 35.800 |
| 0.775 | 0.495 | 35.800 |
| 1.196 | 0.582 | 35.800 |
| 1.280 | 0.597 | 35.800 |
| 1.492 | 0.614 | 35.800 |
| 1.098 | 0.412 | 35.800 |
| 0.452 | 0.083 | 35.800 |
| −0.175 | −0.279 | 35.800 |
| −0.506 | −0.508 | 35.800 |
| −0.570 | −0.557 | 35.800 |
| −1.144 | −0.998 | 35.800 |
| −1.483 | −1.154 | 35.800 |
| −1.514 | −1.120 | 35.800 |
| −1.362 | −0.677 | 35.800 |
| −0.809 | −0.143 | 35.800 |

TABLE 1-continued

| X | Y | Z |
|---|---|---|
| −0.441 | 0.077 | 35.800 |
| −0.364 | 0.115 | 35.800 |
| 0.360 | 0.384 | 35.800 |
| 1.111 | 0.567 | 35.800 |
| 1.468 | 0.628 | 35.800 |
| 1.473 | 0.628 | 35.800 |
| 1.491 | 0.595 | 35.800 |
| 1.244 | 0.480 | 35.800 |
| 0.880 | 0.306 | 35.800 |
| 0.809 | 0.270 | 35.800 |
| 0.171 | −0.074 | 35.800 |
| −0.441 | −0.461 | 35.800 |
| −0.759 | −0.708 | 35.800 |
| −0.821 | −0.760 | 35.800 |
| −1.434 | −1.139 | 35.800 |
| −1.511 | −1.137 | 35.800 |
| −1.512 | −1.095 | 35.800 |
| −1.509 | −1.076 | 35.800 |
| −1.143 | −0.413 | 35.800 |
| −0.517 | 0.037 | 35.800 |
| −0.127 | 0.217 | 35.800 |
| −0.047 | 0.248 | 35.800 |
| 0.692 | 0.475 | 35.800 |
| 1.450 | 0.625 | 35.800 |
| 1.487 | 0.622 | 35.800 |
| 1.490 | 0.618 | 35.800 |

Embodiment 1. A compressor component comprising a root portion, an airfoil portion extending from the root portion, the airfoil portion having an uncoated nominal profile substantially in accordance with Cartesian coordinate values of X, Y, and Z set forth in Table 1, wherein the X, Y, and Z coordinates are distances in inches measured in a Cartesian coordinate system, wherein, at each Z distance, the corresponding X and Y coordinates, when connected by a smooth continuous arc, define one of a plurality of airfoil profile sections, and wherein the plurality of airfoil profile sections, when joined together by smooth continuous arcs, form an airfoil shape.

Embodiment 2. The compressor component of embodiment 1, wherein the root portion and the airfoil portion form at least part of a compressor vane.

Embodiment 3. The compressor component of any of embodiments 1-2, wherein the root portion is configured to couple with a casing of a compressor.

Embodiment 4. The compressor component of any of embodiments 1-3, wherein the airfoil shape lies within an envelope of +/−0.120 inches measured in a direction normal to any of the plurality of airfoil profile sections.

Embodiment 5. The compressor component of any of embodiments 1-4, wherein the airfoil shape lies within an envelope of +/−0.080 inches measured in a direction normal to any of the plurality of airfoil profile sections.

Embodiment 6. The compressor component of any of embodiments 1-5, wherein the airfoil shape lies within an envelope of +/−0.020 inches measured in a direction normal to any of the plurality of airfoil profile sections.

Embodiment 7. The compressor component of any of embodiments 1-6, wherein the airfoil profile is in accordance with at least 85% of the X, Y, and Z coordinate values listed in Table 1.

Embodiment 8. The compressor component of any of embodiments 1-7, further comprising a coating applied to the airfoil shape, the coating having a thickness of less than or equal to 0.010 inches.

Embodiment 9. A compressor vane, comprising an airfoil portion having an uncoated nominal profile substantially in accordance with Cartesian coordinate values of X, Y, and Z set forth in Table 1, wherein the X, Y, and Z coordinate values are distances in inches measured in a Cartesian coordinate system, wherein, at each Z distance, the corresponding X and Y coordinates, when connected by a smooth continuous arc, define one of a plurality of airfoil profile sections, and wherein the plurality of airfoil profile sections, when joined together by smooth continuous arcs, define an airfoil shape.

Embodiment 10. The compressor vane of embodiment 9, wherein the X and Y coordinate values are scalable as a function of a same constant or number and a set of corresponding nominal Z coordinate values are scalable as a function of the same constant or number to provide at least one of a scaled up or a scaled down airfoil.

Embodiment 11. The compressor vane of any of embodiments 9-10, wherein the compressor vane is configured to couple with a plurality of compressor casings each spaced away from a compressor centerline by a different amount, wherein the Z coordinate values set forth in Table 1 are offset by a distance equal to the difference in radial spacing of each said compressor casing to provide at least one of a radially outwardly offset or radially inwardly offset airfoil shape.

Embodiment 12. The compressor vane of any of embodiments 9-11, wherein the airfoil shape lies within an envelope of +/−0.120 inches measured in a direction normal to any of the plurality of airfoil profile sections.

Embodiment 13. The compressor vane of any of embodiments 9-12, wherein the airfoil shape provides the compressor vane with a first bending natural frequency between 130 Hz and 170 Hz when scaled for use in a compressor with a 60 Hz rotation speed.

Embodiment 14. The compressor vane of any of embodiments 9-13, wherein the airfoil shape provides the compressor vane with a first bending natural frequency that differs by at least 5% from $2^{nd}$ and $3^{rd}$ engine order excitations.

Embodiment 15. The compressor vane of any of embodiments 9-14, wherein the airfoil profile is in accordance with at least 85% of the X, Y, and Z coordinate values listed in Table 1.

Embodiment 16. The compressor vane of any of embodiments 9-16, further comprising a coating applied to the airfoil shape, the coating having a thickness of less than or equal to 0.010 inches.

Embodiment 17. A compressor, comprising a casing, a plurality of compressor vanes coupled to the casing, the plurality of compressor vanes circumferentially spaced around the casing and extending towards a center axis of the compressor, wherein each compressor vane of the plurality of compressor vanes has an airfoil comprising an airfoil portion having an uncoated nominal profile substantially in accordance with Cartesian coordinate values of X, Y, and Z set forth in Table 1, wherein the X, Y, and Z coordinate values are distances in inches measured in a Cartesian coordinate system, wherein, at each Z distance, the corresponding X and Y coordinates, when connected by a smooth continuous arc, define one of a plurality of airfoil profile sections, and wherein the plurality of airfoil profile sections, when joined together by smooth continuous arcs, define an airfoil shape.

Embodiment 18. The compressor of embodiment 17, wherein the casing and the plurality of compressor vanes coupled thereto comprise a compressor stage two.

Embodiment 19. The compressor of any of embodiments 17-18, wherein the airfoil shape lies within an envelope of +/−0.120 inches measured in a direction normal to any of the plurality of airfoil profile sections.

Embodiment 20. The compressor of any of embodiments 17-19, wherein the airfoil profile is in accordance with at least 85% of the X, Y, and Z coordinate values listed in Table 1

Embodiment 21. An airfoil, comprising an airfoil profile substantially in accordance with the X, Y, and Z coordinates listed in Table 1, wherein the X, Y, and Z coordinates are distances in inches measured in a Cartesian coordinate system, wherein, at each Z distance, the corresponding X and Y coordinates, when connected by a smooth continuous arc, define one of a plurality of airfoil profile sections, and wherein the plurality of airfoil profile sections, when joined together by smooth continuous arcs, define an airfoil shape.

Embodiment 22. The airfoil of embodiment 21, wherein the airfoil is part of a vane of a gas turbine engine.

Embodiment 23. The airfoil of any of embodiments 21-22, wherein the vane is a compressor vane.

Embodiment 24. The airfoil of any of embodiments 21-23, wherein the airfoil shape lies within an envelope of +/−0.160 inches measured in a direction normal to any of the plurality of airfoil profile sections.

Embodiment 25. The airfoil of any of embodiments 21-24, wherein the airfoil shape lies within an envelope of +/−0.080 inches measured in a direction normal to any of the plurality of airfoil profile sections.

Embodiment 26. The airfoil of any of embodiments 21-25, wherein the airfoil shape lies within an envelope of +/−0.020 inches measured in a direction normal to any of the plurality of airfoil profile sections.

Embodiment 27. The airfoil of any of embodiments 21-26, wherein the airfoil profile is in accordance with at least 85% of the X, Y, and Z coordinates listed in Table 1.

Embodiment 28. The airfoil of any of embodiments 21-27 further comprising a coating.

Embodiment 29. A gas turbine engine vane, comprising an airfoil portion, comprising an airfoil profile substantially in accordance with the X, Y, and Z coordinates listed in Table 1, wherein the X, Y, and Z coordinates are distances in inches measured in a Cartesian coordinate system, wherein, at each Z distance, the corresponding X and Y coordinates, when connected by a smooth continuous arc, define one of a plurality of airfoil profile sections, and wherein the plurality of airfoil profile sections, when joined together by smooth continuous arcs, define an airfoil shape.

Embodiment 30. The gas turbine engine vane of embodiment 29, wherein the airfoil shape defines an airfoil portion of a compressor vane.

Embodiment 31. The gas turbine engine blade of any of embodiments 29-30, wherein the gas turbine engine vane is one of a plurality of gas turbine engine vanes that are assembled about an axis of a gas turbine to form an assembled gas turbine engine stage.

Embodiment 32. The gas turbine engine blade of any of embodiments 29-31, wherein the airfoil shape lies within an envelope of +/−0.160 inches measured in a direction normal to any of the plurality of airfoil profile sections.

Embodiment 33. The gas turbine engine blade of any of embodiments 29-32, wherein the airfoil shape lies within an envelope of +/−0.080 inches measured in a direction normal to any of the plurality of airfoil profile sections.

Embodiment 34. The gas turbine engine blade of any of embodiments 29-33, wherein the airfoil shape lies within an envelope of +/−0.020 inches measured in a direction normal to any of the plurality of airfoil profile sections.

Embodiment 35. The gas turbine engine blade of any of embodiments 29-34, wherein the airfoil profile is in accordance with at least 85% of the X, Y, and Z coordinates listed in Table 1.

Embodiment 36. The gas turbine engine vane of any of embodiments 29-35 further comprising a coating.

Embodiment 37. A gas turbine engine, comprising a plurality of gas turbine engine vanes circumferentially assembled about a center axis of the gas turbine engine, wherein at least one of the plurality of gas turbine engine vanes has an airfoil comprising an airfoil profile substantially in accordance with the X, Y, and Z coordinates listed in Table 1, wherein the X, Y, and Z coordinates are distances in inches measured in a Cartesian coordinate system, wherein, at each Z distance, the corresponding X and Y coordinates, when connected by a smooth continuous arc, define one of a plurality of airfoil profile sections, and wherein the plurality of airfoil profile sections, when joined together by smooth continuous arcs, define an airfoil shape.

Embodiment 38. The gas turbine engine of embodiment 37, wherein the plurality of gas turbine engine vanes form an assembled compressor stage.

Embodiment 39. The gas turbine engine of any of embodiments 37-38, wherein the airfoil shape lies within an envelope of +/−0.160 inches measured in a direction normal to any of the plurality of airfoil profile sections.

Embodiment 40. The gas turbine engine of any of embodiments 37-39, wherein the airfoil profile is in accordance with at least 85% of the X, Y, and Z coordinates listed in Table 1.

Embodiment 41. Any of the aforementioned embodiments 1-40, in any combination.

The subject matter of this disclosure has been described in relation to particular embodiments, which are intended in all respects to be illustrative rather than restrictive. Alternative embodiments will become apparent to those of ordinary skill in the art to which the present subject matter pertains without departing from the scope hereof. Different combinations of elements, as well as use of elements not shown, are also possible and contemplated.

What is claimed is:

1. A compressor component comprising:

a root portion; and an airfoil portion extending from the root portion, the airfoil portion having an uncoated nominal profile substantially in accordance with Cartesian coordinate values of X, Y, and Z set forth in Table 1, wherein the X, Y, and Z coordinates are distances in inches measured in a Cartesian coordinate system, wherein a point of origin of the orthogonally related X, Y, and Z axes is located on an engine centerline, wherein, at each Z distance, the corresponding X and Y coordinates, when connected by a smooth continuous arc, define one of a plurality of airfoil profile sections, and wherein the plurality of airfoil profile sections, when joined together by smooth continuous arcs, form an airfoil shape.

2. The compressor component of claim 1, wherein the root portion and the airfoil portion form at least part of a compressor vane.

3. The compressor component of claim 1, wherein the root portion is configured to couple with a casing of a compressor.

4. The compressor component of claim 1, wherein the airfoil shape lies within an envelope of +/−0.120 inches measured in a direction normal to any of the plurality of airfoil profile sections.

5. The compressor component of claim 1, wherein the airfoil shape lies within an envelope of +/−0.080 inches measured in a direction normal to any of the plurality of airfoil profile sections.

6. The compressor component of claim 1, wherein the airfoil shape lies within an envelope of +/−0.020 inches measured in a direction normal to any of the plurality of airfoil profile sections.

7. The compressor component of claim 1, wherein the airfoil profile is in accordance with at least 85% of the X, Y, and Z coordinate values listed in Table 1.

8. The compressor component of claim 1, further comprising a coating applied to the airfoil shape, the coating having a thickness of less than or equal to 0.010 inches.

9. A compressor vane, comprising:

an airfoil portion having an uncoated nominal profile substantially in accordance with Cartesian coordinate values of X, Y, and Z set forth in Table 1, wherein the X, Y, and Z coordinate values are distances in inches measured in a Cartesian coordinate system, wherein a point of origin of the orthogonally related X, Y, and Z axes is located on an engine centerline, wherein, at each Z distance, the corresponding X and Y coordinates, when connected by a smooth continuous arc, define one of a plurality of airfoil profile sections, and wherein the plurality of airfoil profile sections, when joined together by smooth continuous arcs, define an airfoil shape.

10. The compressor vane of claim 9, wherein the X and Y coordinate values are scalable as a function of a same constant or number and a set of corresponding nominal Z coordinate values are scalable as a function of the same constant or number to provide at least one of a scaled up or a scaled down airfoil.

11. The compressor vane of claim 10, wherein the compressor vane is configured to couple with a plurality of compressor casings each spaced away from a compressor centerline by a different amount, wherein the Z coordinate values set forth in Table 1 are offset by a distance equal to the difference in radial spacing of each said compressor casing to provide at least one of a radially outwardly offset or radially inwardly offset airfoil shape.

12. The compressor vane of claim 9, wherein the airfoil shape lies within an envelope of +/−0.120 inches measured in a direction normal to any of the plurality of airfoil profile sections.

13. The compressor vane of claim 9, wherein the airfoil shape provides the compressor vane with a first bending natural frequency between 130 Hz and 170 Hz when scaled for use in a compressor with a 60 Hz rotation speed.

14. The compressor vane of claim 9, wherein the airfoil shape provides the compressor vane with a first bending natural frequency that differs by at least 5% from $2^{nd}$ and $3^{rd}$ engine order excitations.

15. The compressor vane of claim 9, wherein the airfoil profile is in accordance with at least 85% of the X, Y, and Z coordinate values listed in Table 1.

16. The compressor vane of claim 9, further comprising a coating applied to the airfoil shape, the coating having a thickness of less than or equal to 0.010 inches.

17. A compressor, comprising:

a casing; and a plurality of compressor vanes coupled to the casing, the plurality of compressor vanes circumferentially spaced around the casing and extending towards a center axis of the compressor, wherein each compressor vane of the plurality of compressor vanes has an airfoil comprising:

an airfoil portion having an uncoated nominal profile substantially in accordance with Cartesian coordinate values of X, Y, and Z set forth in Table 1, wherein the X, Y, and Z coordinate values are distances in inches measured in a Cartesian coordinate system, wherein a point of origin of the orthogonally related X, Y, and Z axes is located on an engine centerline, wherein, at each Z distance, the corresponding X and Y coordinates, when connected by a smooth continuous arc, define one of a plurality of airfoil profile sections, and wherein the plurality of airfoil profile sections, when joined together by smooth continuous arcs, define an airfoil shape.

18. The compressor of claim 17, wherein the casing and the plurality of compressor vanes coupled thereto comprise a compressor stage two.

19. The compressor of claim 17, wherein the airfoil shape lies within an envelope of +/−0.120 inches measured in a direction normal to any of the plurality of airfoil profile sections.

20. The compressor of claim 17, wherein the airfoil profile is in accordance with at least 85% of the X, Y, and Z coordinate values listed in Table 1.

* * * * *